US010737872B2

(12) United States Patent
Kinarti et al.

(10) Patent No.: US 10,737,872 B2
(45) Date of Patent: Aug. 11, 2020

(54) DISPENSING MECHANISM AND ASSOCIATED CARTRIDGE AND CARRIER

(71) Applicant: SUNZEE LTD., Michmoret (IL)

(72) Inventors: Heday Kinarti, Michmoret (IL); Nitsan Nir, Bnei-Zion (IL); Ori Ram, Ramat-HaSharon (IL); Nir Nagar, Ganei-Tikva (IL); Amnon Slutski, Doar-Na Emek Beit SheAn (IL); Sagi Slutski, Zikhron-Yaakov (IL)

(73) Assignee: SUNZEE LTD., Ramat-Hasharon (IL)

( * ) Notice: Subject to any disclaimer, the term of this patent is extended or adjusted under 35 U.S.C. 154(b) by 0 days.

(21) Appl. No.: 16/087,494

(22) PCT Filed: Mar. 28, 2017

(86) PCT No.: PCT/IL2017/050383

§ 371 (c)(1),
(2) Date: Sep. 21, 2018

(87) PCT Pub. No.: WO2017/168417

PCT Pub. Date: Oct. 5, 2017

(65) Prior Publication Data

US 2019/0106264 A1 Apr. 11, 2019

Related U.S. Application Data

(60) Provisional application No. 62/366,139, filed on Jul. 25, 2016, provisional application No. 62/366,172, (Continued)

(51) Int. Cl.
*B65D 83/00* (2006.01)
*A45D 33/33* (2006.01)
(Continued)

(52) U.S. Cl.
CPC ..... *B65D 83/0094* (2013.01); *A45D 33/33* (2013.01); *A45D 34/00* (2013.01);
(Continued)

(58) Field of Classification Search
CPC ..... B65D 83/0094; A45D 2034/005; A45D 2034/007
See application file for complete search history.

(56) References Cited

U.S. PATENT DOCUMENTS 4,667,845 A 5/1987 Frazier
2005/0124945 A1* 6/2005 Powers ..... A45D 34/00 604/310

(Continued)

FOREIGN PATENT DOCUMENTS

DE 202006011305 U1 10/2006
EP 0385879 A1 9/1990

*Primary Examiner* — J C Jacyna

(57) ABSTRACT

A dispensing mechanism dispenses even doses of a substance, and comprises a base, a leverable surface, a stepper mechanism; and a space for an application substance. The levered surface is hinged at one end or is collapsible and is pressed downwards towards the base to squeeze the space to force the substance out of the cartridge. The stepper mechanism is located at the far end of the leverable surface to halt pressing at intervals corresponding to even doses of the substance. A carrier for a cartridge incorporating the dispensing mechanism comprises a housing which may be pressed to squeeze the cartridge and dispense the substance, an insertion opening through which the dispensing cartridge is inserted and a dispensing opening which lines up with a spout on the cartridge and through which the liquid is dispensed. The carrier may be attached to the wrist or to bicycle handlebars and the like.

14 Claims, 45 Drawing Sheets

Related U.S. Application Data filed on Jul. 25, 2016, provisional application No. 62/314,970, filed on Mar. 29, 2016, provisional application No. 62/313,834, filed on Mar. 28, 2016.

(51) Int. Cl.

| | |
|---|---|
| ***A45F 5/02*** | (2006.01) |
| ***A45D 34/00*** | (2006.01) |
| *A45F 5/00* | (2006.01) |

(52) U.S. Cl.

CPC ..... *A45F 5/02* (2013.01); *A45F 5/021* (2013.01); *A45D 2034/005* (2013.01); *A45D 2034/007* (2013.01); *A45F 2005/008* (2013.01)

(56) References Cited

U.S. PATENT DOCUMENTS

| | | | | |
|---|---|---|---|---|
| 2007/0023453 | A1* | 2/2007 | Simkins | A47K 5/1201 222/183 |
| 2010/0084432 | A1* | 4/2010 | Pelfrey | A45D 34/04 222/153.13 |
| 2015/0158042 | A1* | 6/2015 | Parker | B05B 11/048 222/175 |

* cited by examiner 508
508
506
504
510
506
512
508

502
502

24
32
30
44
42
12
34
40
20
30

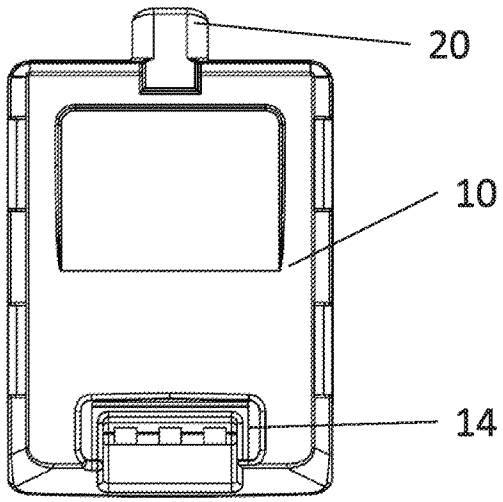
Fig. 8A
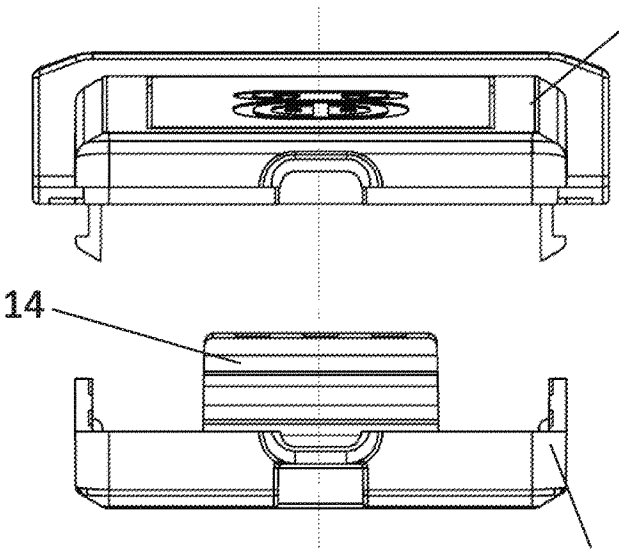
Fig. 8B
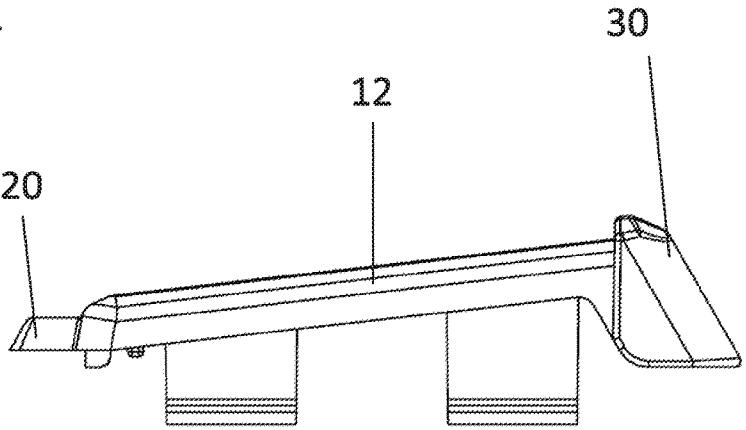
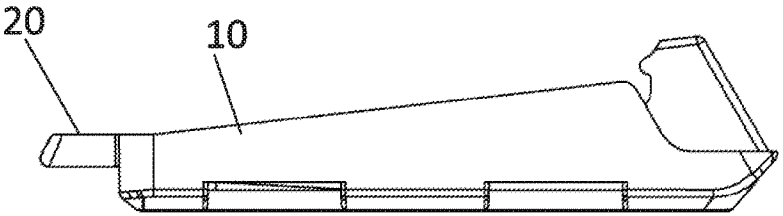
Fig. 8C

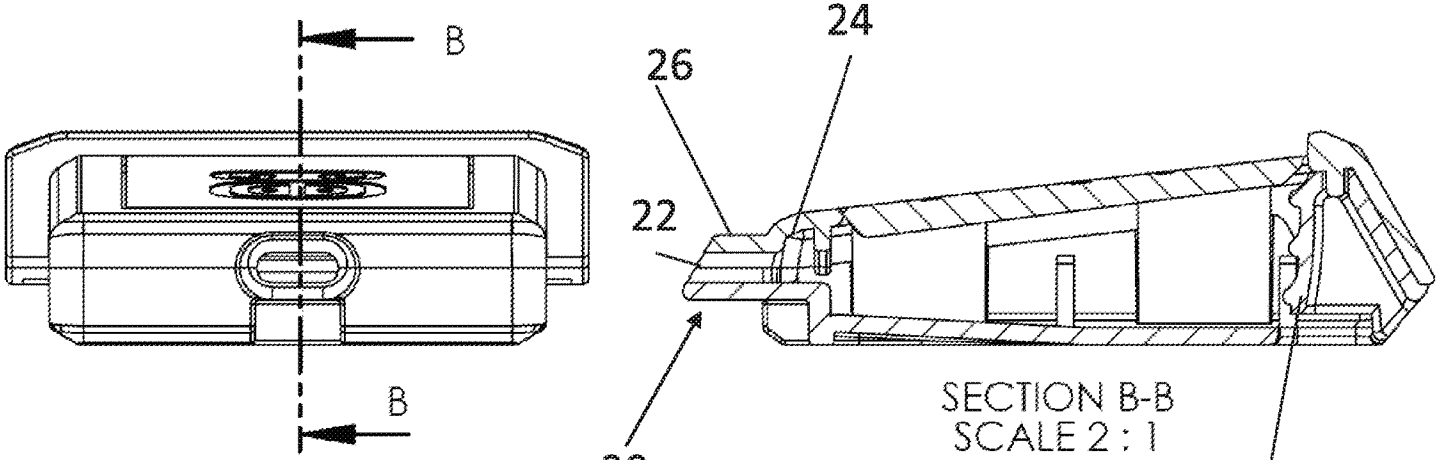
Fig. 8E
Fig. 8F
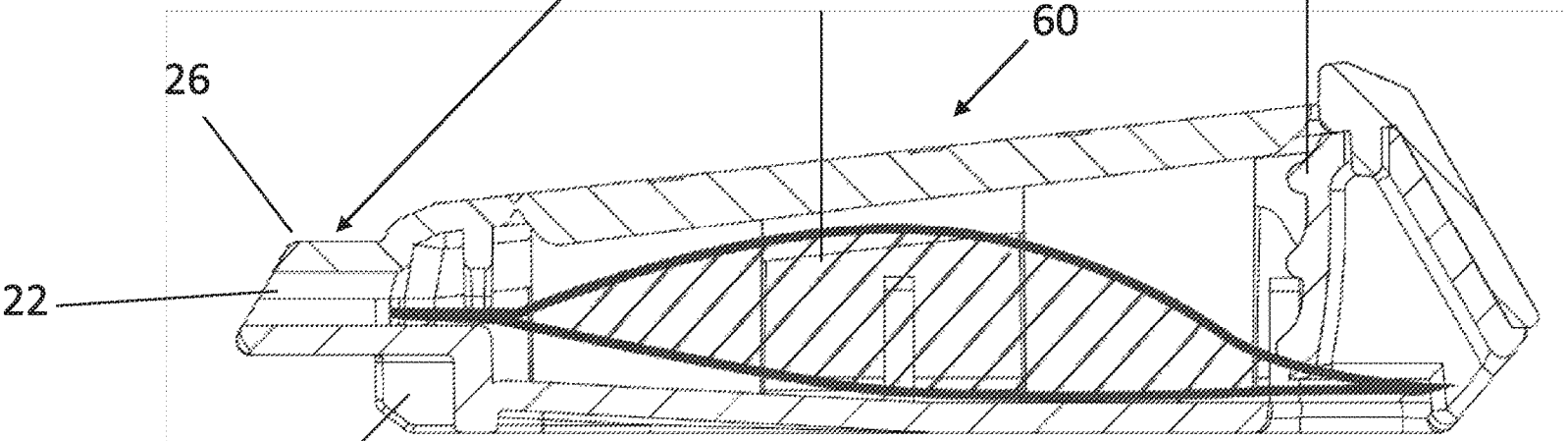
Fig. 9A

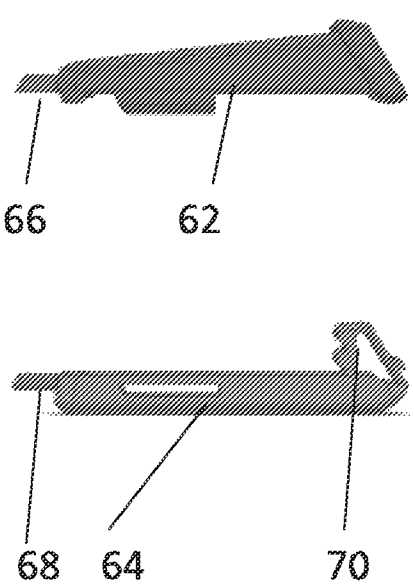
Fig. 15
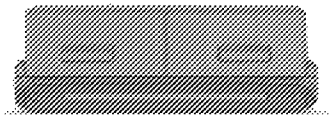
Fig. 16
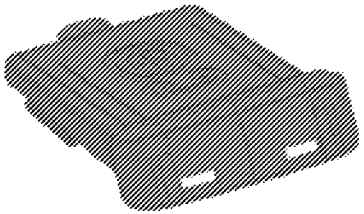
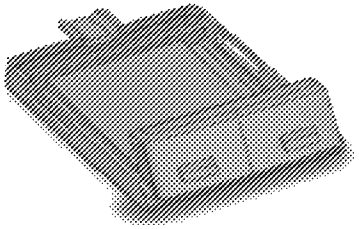
Fig. 17

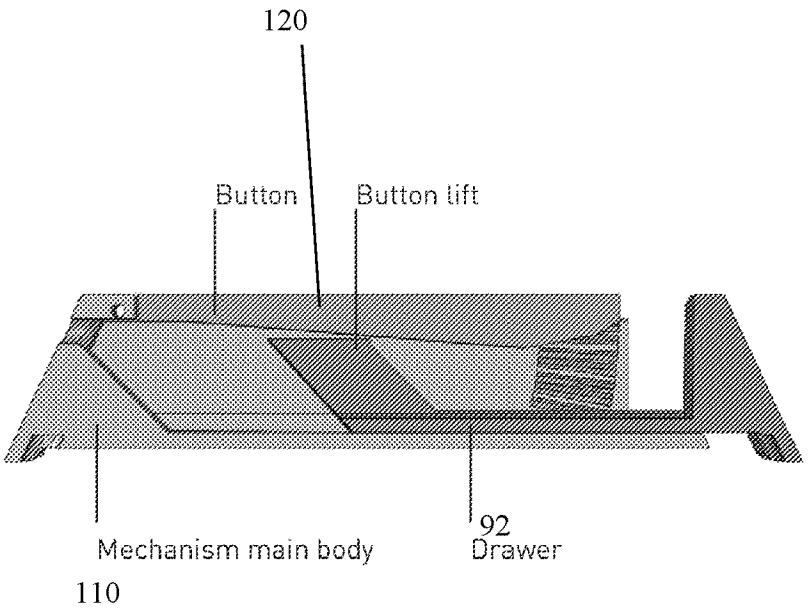
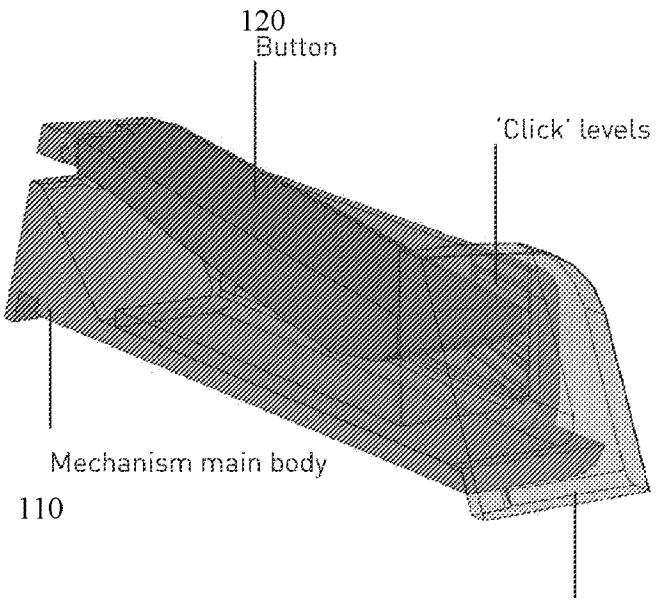
Fig. 22

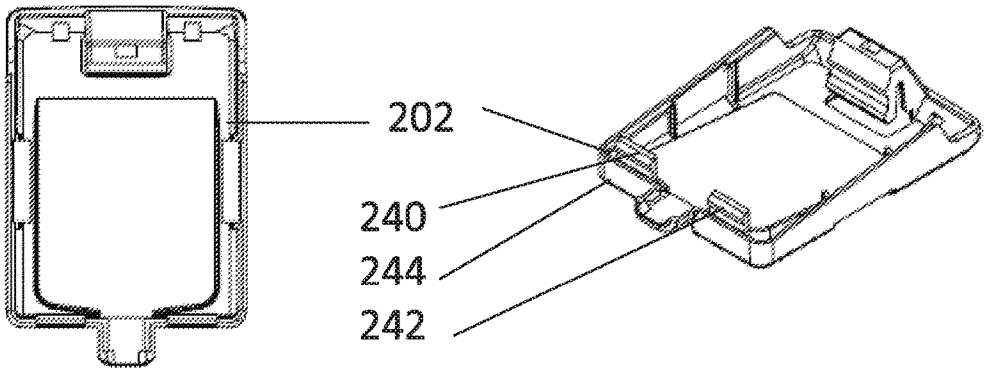
Fig. 26F
Fig. 26G
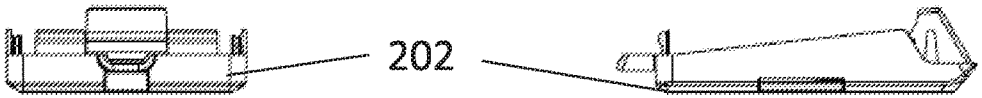
Fig. 26H
Fig. 26I
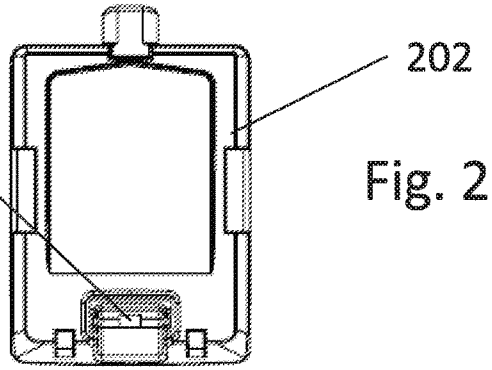
Fig. 26J

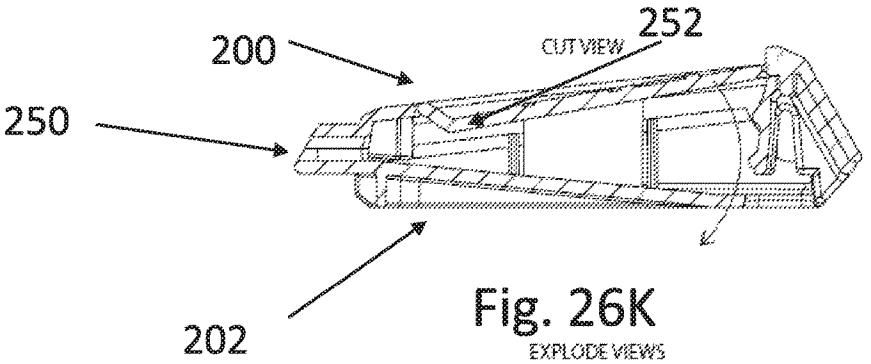
Fig. 26K
EXPLODE VIEWS
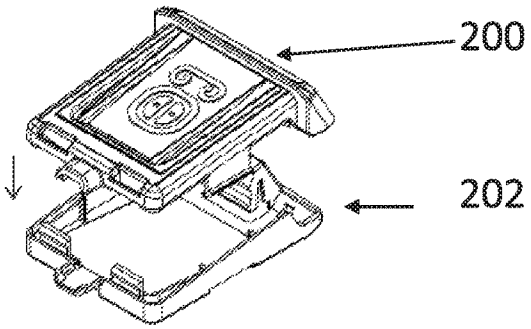
Fig. 26L
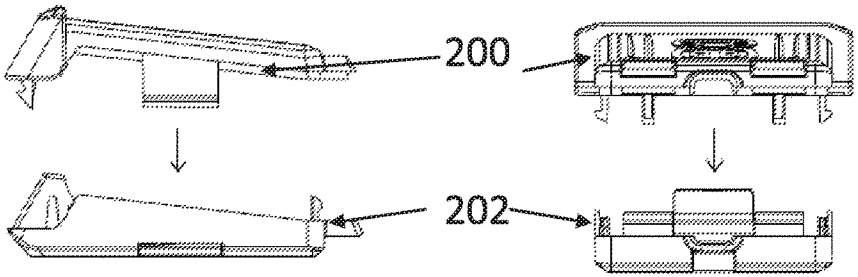
Fig. 26M
Fig. 26N

316

306
314

322
320
306
310
312
306

318

306

Holder
300
305
302
300
302
304
300
Assembled
306
304
305
302

Jacket
Capsule
308
306
Holder
304

DISPENSING MECHANISM AND ASSOCIATED CARTRIDGE AND CARRIER

FIELD AND BACKGROUND OF THE INVENTION

The present invention, in some embodiments thereof, relates to a dispensing mechanism and, more particularly, but not exclusively, to a dispensing mechanism and an associated cartridge.

Preparations for use on the skin tend to dry out or lose their effectiveness after a certain amount of time and need to be reapplied. However, in the middle of outdoor activities, in particular sports, it is unlikely that people will remember to reapply and even if they do, it is often very inconvenient to stop in order to do so, or a container with the substance may not be readily available.

The substances may be any pharmaceutical, dermatological, cosmetic or other substance that is applied, and of particular interest are any substance that is applied at regular intervals.

Generally, at the time of reapplication, the user, especially an active user, may not have the substance to hand and may not wish or may not be in a position to interrupt the current activity in order to reapply the substance.

One particular product for application to the skin is sunscreen. One in five Americans will develop skin cancer during the course of their lives, according to figures from the American Skin Cancer Foundation.

Athletes in outdoor sports, children and adults engaged in outdoor activities, soldiers and outdoor labourers are all prone to long periods of exposure to the sun during exercise, fun and work and need an easy way to reapply sunscreen, for example every 60-80 minutes to protect their skin.

Experiments conducted with many products, including sunscreen, show that when a product is in sight, easily accessible and within reach, people use the product more often.

Larger, international brands have recognized the need of sunscreen for active users. Piz Buin, Blockband and Myozone have created sunscreen wristbands/holders—however they are bulky, not stylish, and are largely impractical for everyday use.

Zinka, Shiseido, Vertra, Headhunters, and other companies sell facial sun block sticks small enough to place in your pocket. However, sunblock sticks are not within sight, are virtually impossible to apply in an even manner to the face and are impossible to use while engaged in sports. None of these solve the practical problem of reapplication.

SUMMARY OF THE INVENTION

The present embodiments use a squeezable or pressable cartridge mechanism that may be operated using a single hand and which squeezes out a measurable dose of cream.

According to one aspect of the present embodiments there is provided a dispensing mechanism for providing doses of a substance, comprising:

a base;

a leverable surface;

a stepper mechanism; and a space for an application substance, the space being defined between the base part and the leverable surface, the levered surface being retained at a first end and being downwardly pressable towards the base.

In an embodiment, the stepper mechanism is located at a second end of the leverable surface to halt the leverable surface at predetermined intervals corresponding to even doses of the application substance.

An embodiment may comprise an aperture located between the lever and the base for a directed exit of the application substance.

In an embodiment, a spout extends outwardly from the aperture, and may have a one way valve.

In an embodiment, the stepper mechanism comprises a series of teeth extending inwardly from an outer wall of the cartridge, each tooth designed to catch the second end of the leverable surface.

In an embodiment, the outer wall opposite the hinge further comprises an indicator showing a current level of the leverable surface, and hence the amount of remaining substance.

In an embodiment, the indicator comprises a groove in the outer wall and a tab extending outwardly from the leverable surface through the groove.

An embodiment may comprise side walls extending upwards laterally from the base at opposite sides of the leverable surface, the side walls extending upwardly beyond an uppermost position of the leverable surface.

An embodiment may be sized to allow the leverable surface to be operable by one finger while remaining fingers are placed opposite the spout to receive the application substance.

The space may comprise a liner, the liner holding the application substance. A location on a wall of the liner is weakened relative to a remainder of the liner wall, thereby to ensure that the liner bursts at the weakened location when pressure is applied to the liner. The liner may have a weakened area or tear away feature, extending outwards from the spout.

The spout may be located between the hinge and the base for a directed exit of the application substance, and the liner being aligned such that the weakened location is against the spout. The weakened location may have a weakened area or tear away, extending outwards from the spout.

In embodiments, the application substance is one member of the group consisting of a powder, a liquid, an oil, an emulsion, a gel and a cream.

In embodiments, the base, the leverable surface, and the stepper mechanism are part of a carrier having a dispensing drawer, and a cartridge holding the application substance is located in the drawer. The cartridge may have transverse pleats along a side wall to allow the cartridge to be squeezed longitudinally, or longitudinal pleats along a side wall to allow the cartridge to be squeezed transversely.

The base, the leverable surface, and the stepper mechanism may be part of a cartridge containing the substance for application.

The cartridge may be refillable for second and subsequent use, or may be for single use only.

The base and the leverable surface may be hingeably connected.

The dispensing mechanism may be inserted within a carrier, and the carrier may comprise straps for attaching to a wrist or the arms of a bicycle or the like.

According to a second aspect of the present invention there is provided a method of dispensing measured doses of a substance for application, the method comprising:

placing the substance in a space between a base and a hinged lever; and pressing the lever between a first click point and a second click point to squeeze the substance for application from the space, the distance between the two click points defining a measured dose and thus a quantity of the substance.

According to a third aspect of the present invention there is provided a dispensing mechanism for providing doses of a substance, comprising:

a base;

a leverable surface;

a space for an application substance, the space being defined between the base and the leverable surface by a surrounding wall; and a dispensing aperture in the surrounding wall, the leverable surface being retained at a first end and being downwardly pressable towards the base to squeeze the substance out of the space via the dispensing opening.

According to a further aspect of the present invention there is provided a dispensing mechanism for providing doses of a substance, comprising:

a base;

a leverable surface; and a space for an application substance, the space being defined between the base part and the leverable surface, the levered surface being retained at a first end and being downwardly pres sable towards the base in a dispensing stroke to constrict the space, thereby to dispense the substance, the stroke terminating when the lever comes into contact with the base.

According to a yet further aspect of the present embodiments there is provided a carrier for a dispensing cartridge, the dispensing cartridge for dispensing doses of a substance to be dispensed, the carrier comprising:

a housing for containing the dispensing cartridge, the housing being pressable to allow the cartridge to be squeezed to dispense the substance;

an insertion opening at a first end of the housing through which the dispensing cartridge is removably insertable; and a dispensing opening at a second end of the housing configured to line up with a spout on the dispensing cartridge and through which the liquid is dispensable.

The housing may be flexible or rigid as long as it can be pressed at one location.

In an embodiment, the carrier contains the dispensing cartridge.

In an embodiment, the dispensing cartridge comprises:

a base;

a leverable surface; and a space, the space being defined between the base and the leverable surface, the levered surface being hinged at a first end and being downwardly pressable towards the base to squeeze the space to force the substance in the space to exit from the dispenser.

In an embodiment, the dispensing cartridge further comprises a stepper mechanism; the stepper mechanism being located at a second end of the leverable surface to halt the leverable surface at predetermined intervals corresponding to doses of the substance.

In an embodiment, the stepper mechanism comprises a series of teeth extending inwardly from an outer wall of the dispenser opposite the hinge, each tooth being configured to catch the second end of the leverable surface.

In an embodiment, the outer wall opposite the hinge protrudes outwardly of the housing and further comprises an indicator showing a current level of the leverable surface.

In an embodiment, the indicator comprises a groove in the outer wall and a tab extending outwardly from the leverable surface through the groove, the tab being visible externally of the housing.

An embodiment may comprise a strap for attachment to an arm.

Embodiments may be sized to allow the leverable surface to be operated by one finger while remaining fingers are placed opposite the spout to receive the substance.

An embodiment of the carrier may comprise an attachment for attaching to a key ring, or an attachment for attaching to handlebars of a two or three-wheeled vehicle or a ski-vehicle or a sled or to a cylindrical object, or an attachment for attaching to a bag, or an attachment for attachment to a watch or a wearable device or a mobile telephone or portable device or a bracelet, or an attachment for attaching to clothing. In all cases, attaching may be by gluing or sewing, and may be carried out at the time of manufacture or later.

An attachment may comprise Velcro™ or double sided sticky tape.

An attachment may be provided for attaching to part of a watercraft, such as a surfboard, a windsurfing board, a rowing boat, a yacht, or a speed boat.

An adapter may be provided for attaching to a port of a wearable or portable device.

Attachment may be by sewing, or any other way, as mentioned.

The carrier may be attached to a necklace or bangle.

According to a further embodiment of the present invention there is provided a liner for holding a dispensing substance within a dispensing mechanism, the dispensing mechanism for dispensing through an opening by squeezing on the liner to dispense the dispensing substance, the liner comprising upper and lower walls welded together along at least one weld, the weld having a weakened section located for placement opposite the opening.

In an embodiment, the at least one weld is welded by double application of heat, and the weakened section is welded by a single application of heat. Alternatively the weakened section is made by applying a lower level of heat or pressure in either one or two applications of heat.

A liner may have two welds, and a weakened section in one of the welds.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced. In the Drawings:

FIGS. 8A-8F are six views showing the upper and lower sections of the cartridge being placed together according to an embodiment of the present invention;

FIG. 9A shows a liner fitted in between the upper and lower parts of the cartridge according to embodiments of the present invention, and illustrating how the cartridge may be shaped to hold the liner stationary;

FIG. 15 is a schematic side view of the cartridge of FIG. 10;

FIG. 16 is a view from the rear of the cartridge of FIG. 10;

FIG. 17 is a perspective view of the upper and lower parts of the cartridge of FIG. 10;

FIG. 22 illustrates squeezing and then pulling out the mechanism of the carrier of FIG. 20;

FIG. 44 illustrates a carrier attached to the assembled ring part and platform of FIG. 43;

DESCRIPTION OF SPECIFIC EMBODIMENTS OF THE INVENTION

Figure 1A:
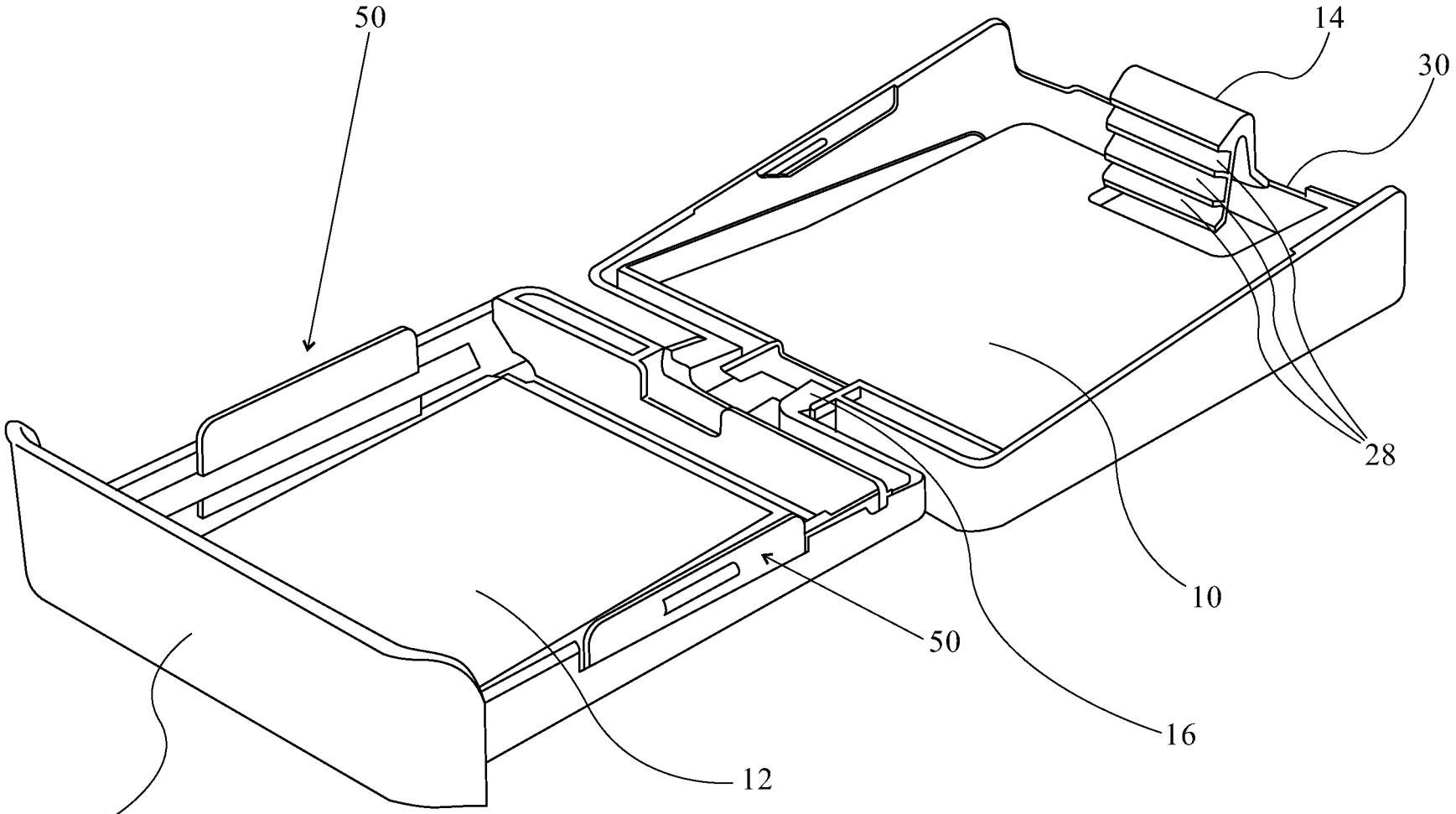
FIG. 1A is a photograph of a cartridge according to a first embodiment of the present invention in an open state before insertion of a liner.
Figure 1C:
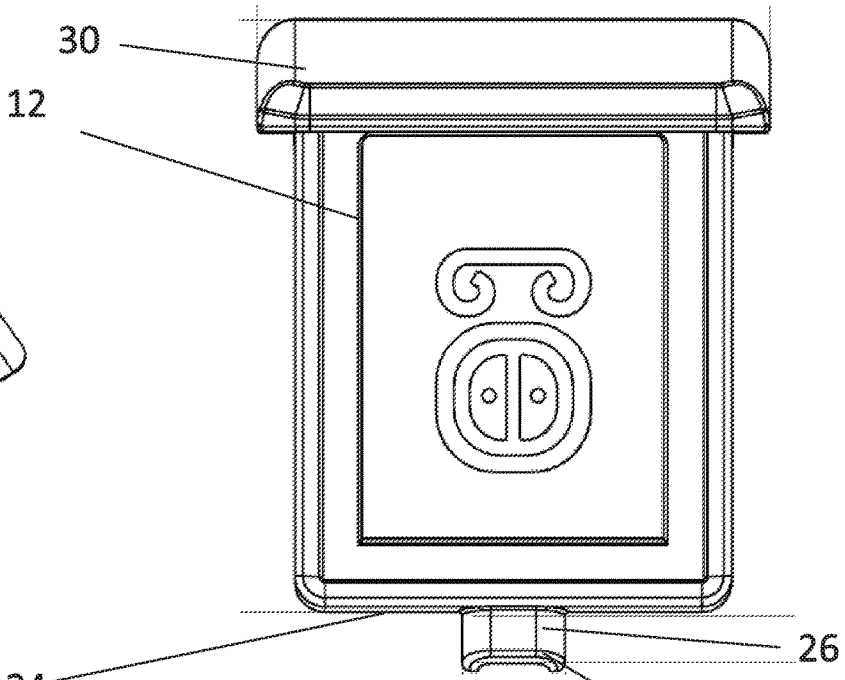
FIGS. 1B-1G are views from different perspectives of different versions of the upper surface of the cartridge of FIG. 1A.
Figure 1E:
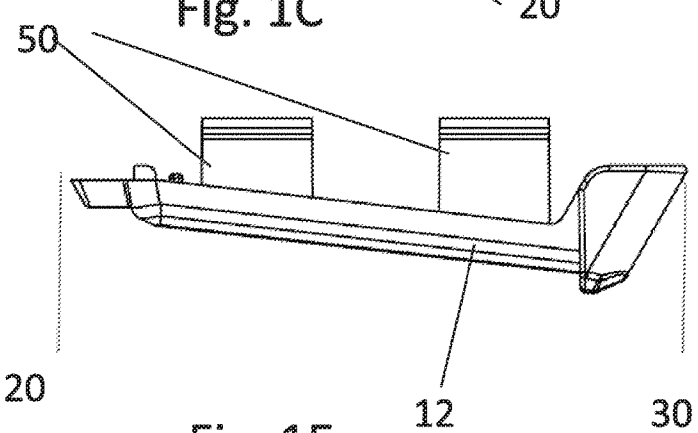
Figure 1B:
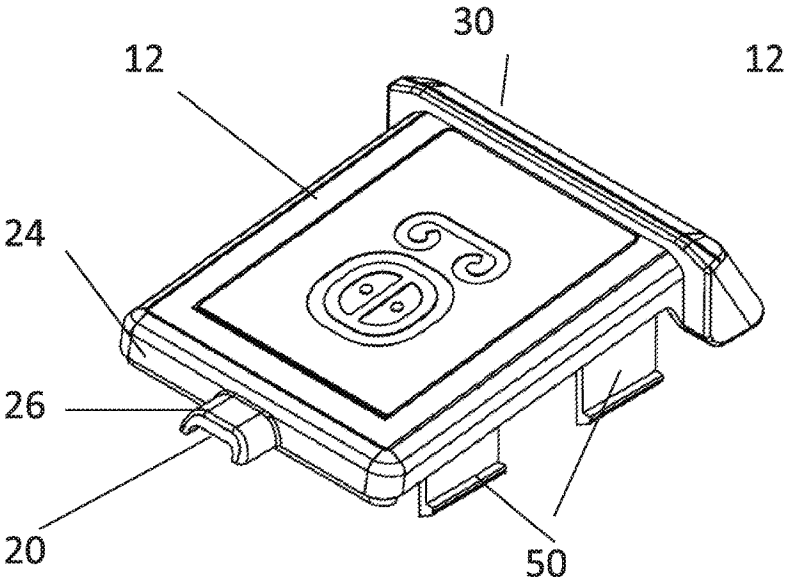
Figure 1D:
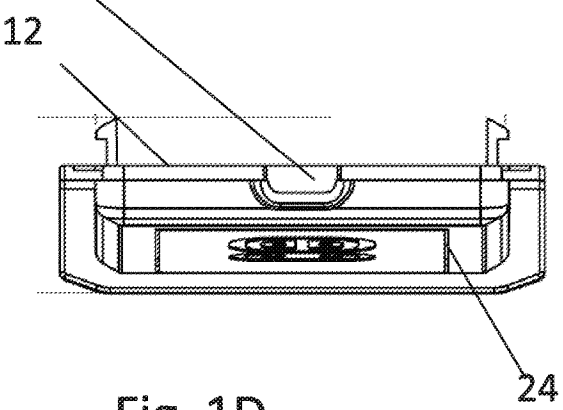
Figure 1G:
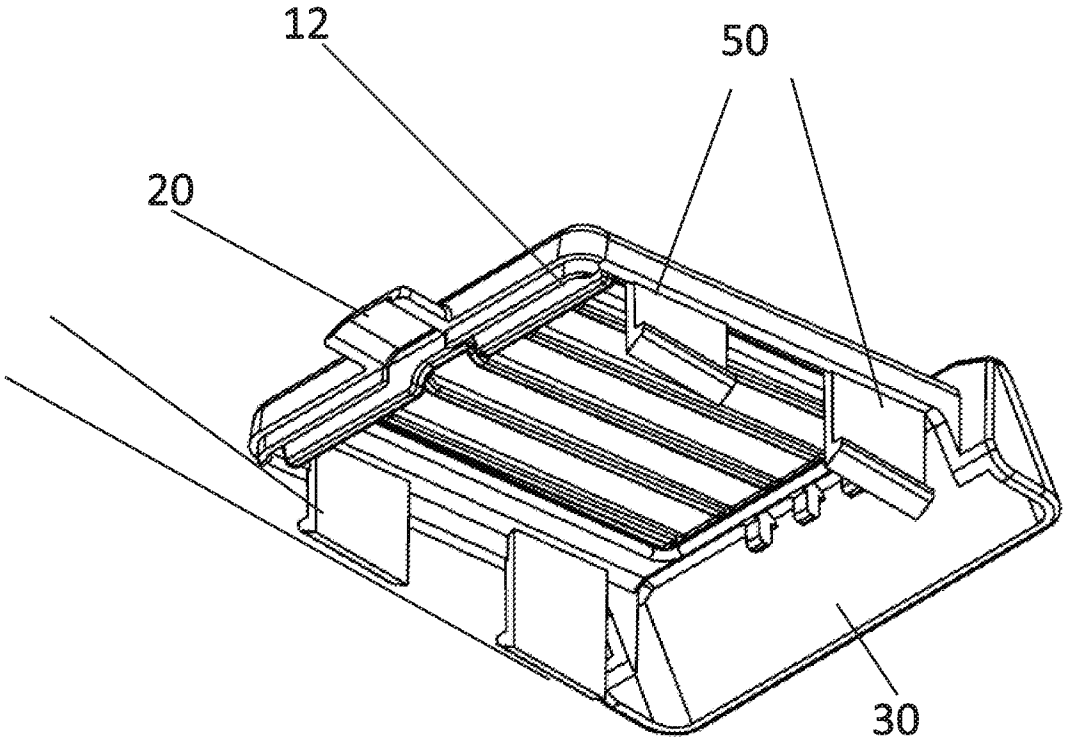
Figure 1F:
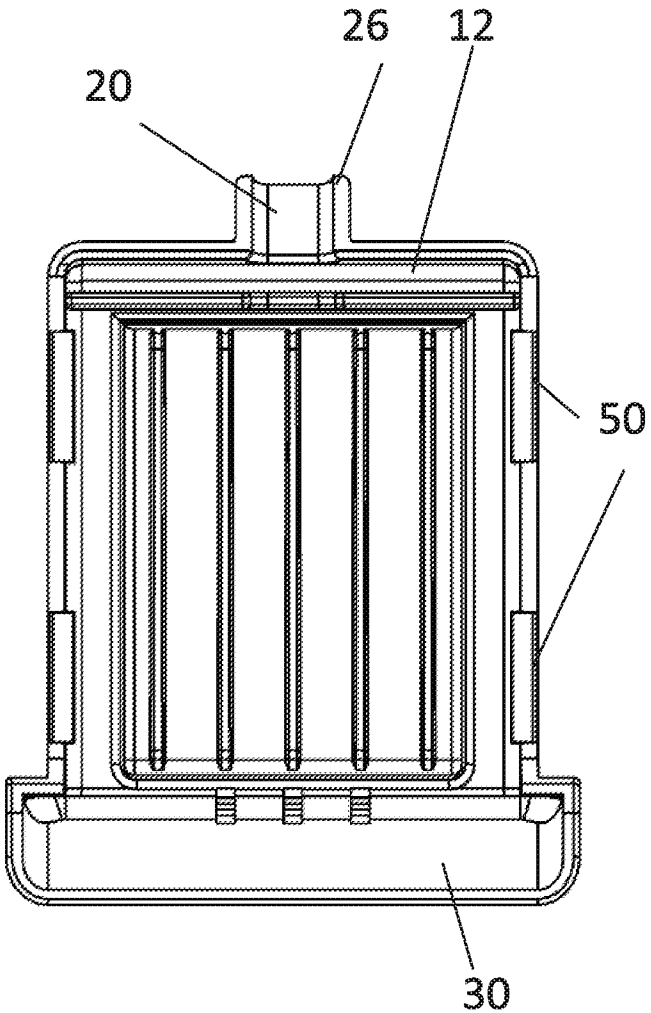

The present invention, in some embodiments thereof, relates to a cartridge and a dispensing mechanism and, more particularly, but not exclusively, to a dispensing cartridge, and also to a carrier for the cartridge and for dispensing cartridges in general.

A dispensing mechanism dispenses even doses of a substance, and may comprise a base, a leverable surface, an optional stepper mechanism; and a space for an application substance. The levered surface may be hinged at one end and is pressed downwards towards the base to squeeze the space to force the substance out of the cartridge. The stepper mechanism is located at the far end of the leverable surface to halt pressing at intervals corresponding to even doses of the substance. The dispensing mechanism may be incorporated into a cartridge, which may be refillable or disposable. The stepper mechanism in particular may be dispensed with in some embodiments.

A carrier for a cartridge incorporating the dispensing mechanism comprises:

a housing which, may be flexible and may be pressed to squeeze the cartridge and dispense the substance;

an insertion opening through which the dispensing cartridge is inserted; and a dispensing opening which lines up with a spout on the cartridge and through which the liquid is dispensed. The carrier may be attached to the wrist or to bicycle handlebars and the like.

The application substance may be a pharmaceutical or a cosmetic substance or any other substance for external application to the skin that is applied in measured doses and in particular any such substance that needs to be reapplied at intervals, or any consumable substance. The cartridge contains a space with the dispensing fluid and closes stepwise into the space to force out the fluid. The steps are arranged to issue a measured dose, or dose indication, with each press. The cartridge may be arranged to be operated by the user's fingers to dispense the substance as required and can be worn, say on the arm to be available when needed. In this way, people in the middle of activities, including building workers, sportsmen etc can take doses at the required intervals without interrupting their activities.

The carrier may include a surface that may be pressed to operate the cartridge and dispense the dose.

The cartridges may be refillable, or designed for single use, as preferred.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 2A:
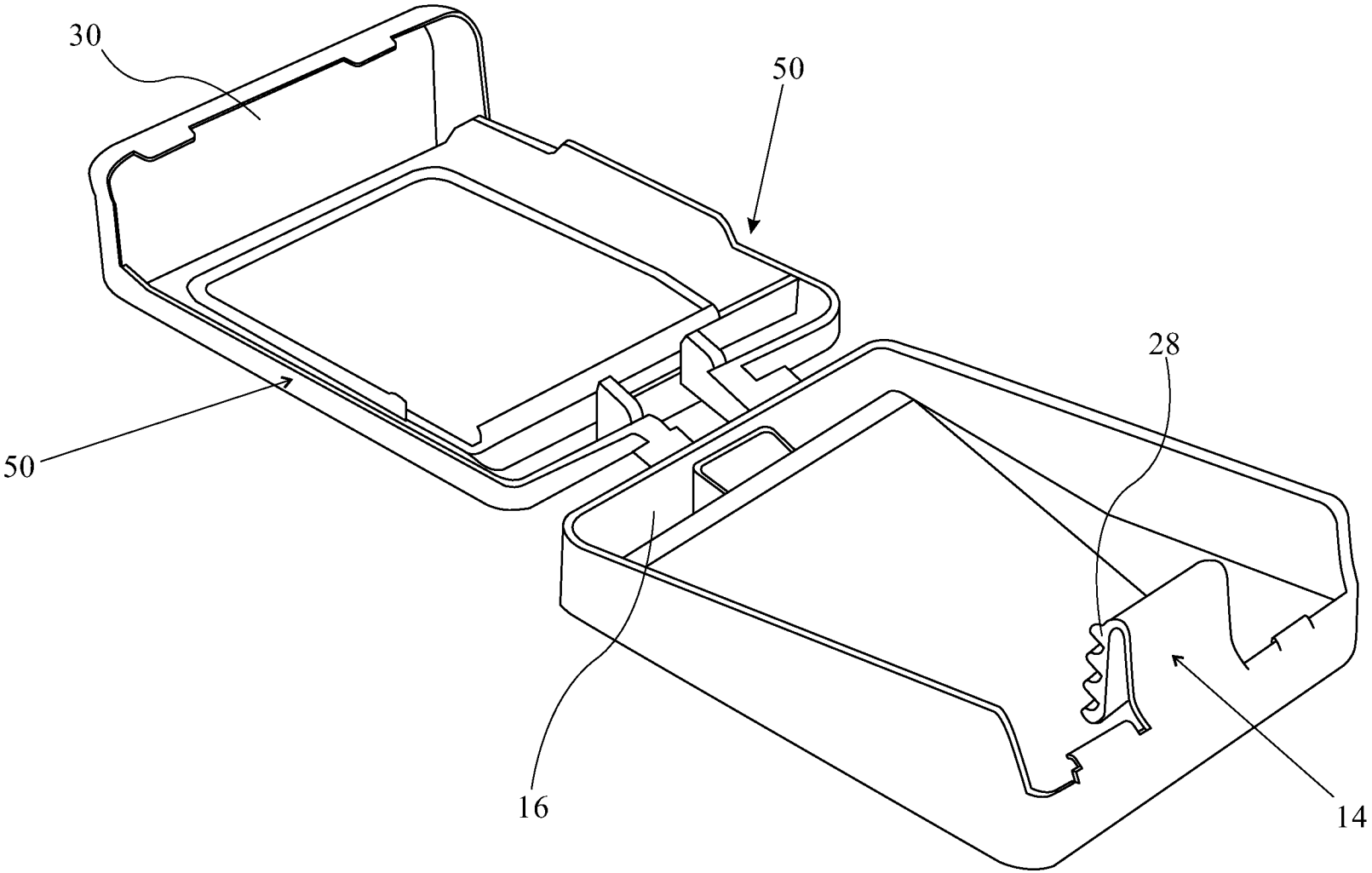
FIG. 2A is a photograph of the cartridge of FIG. 1A from the opposite direction.
Figure 2C:
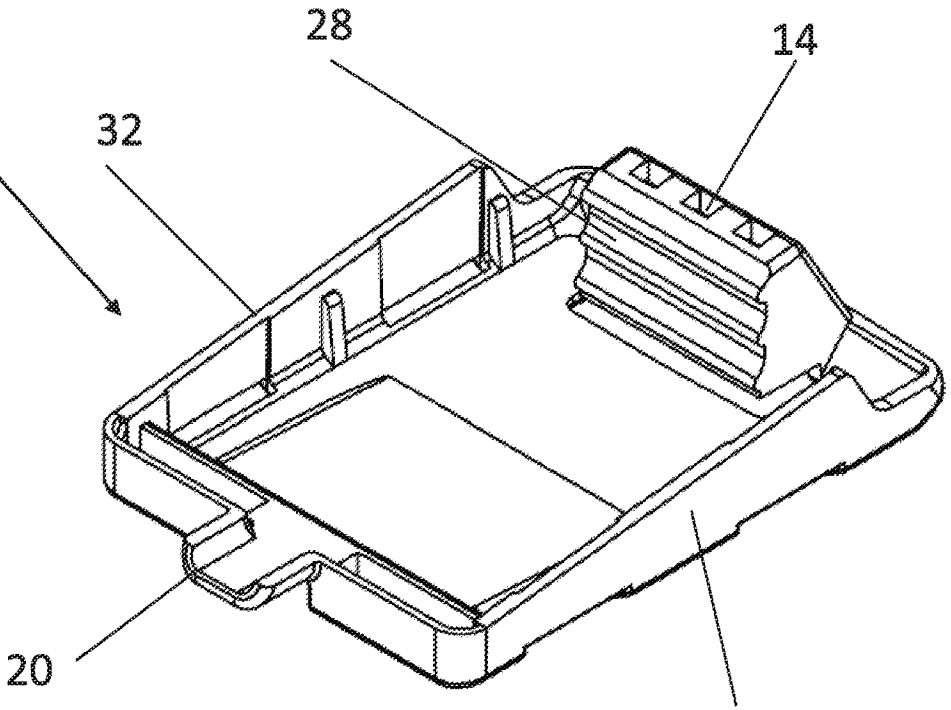
FIGS. 2B-2G are views from different perspectives of different versions of the base of FIG. 2A.
Figure 2B:
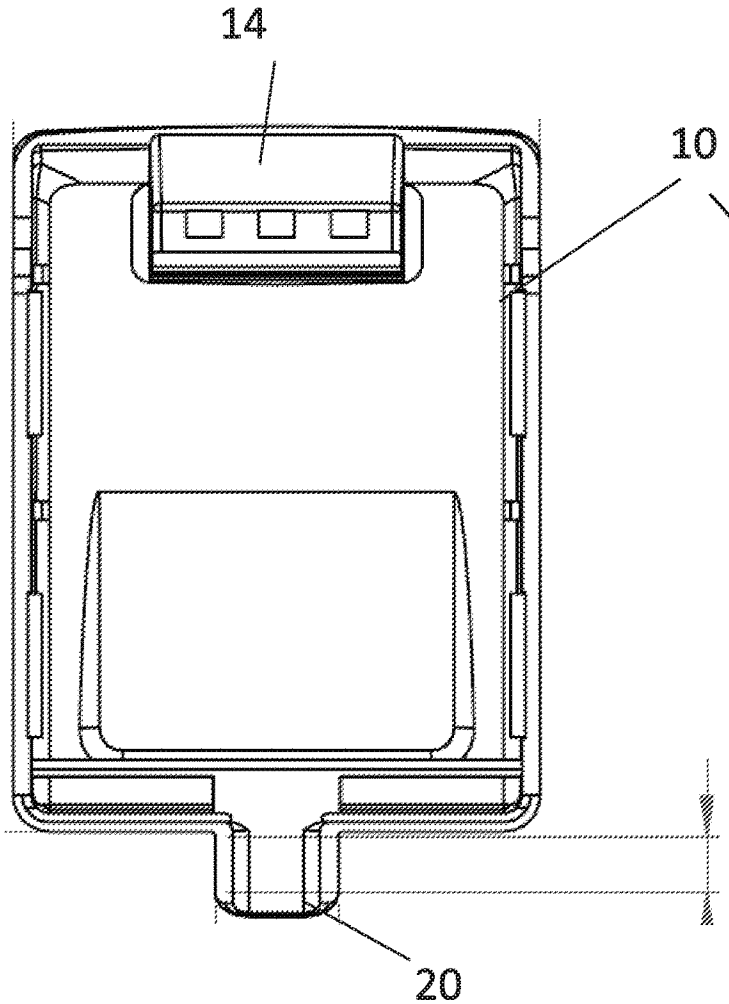
Figures 2D, 2E, 2F, 2G:
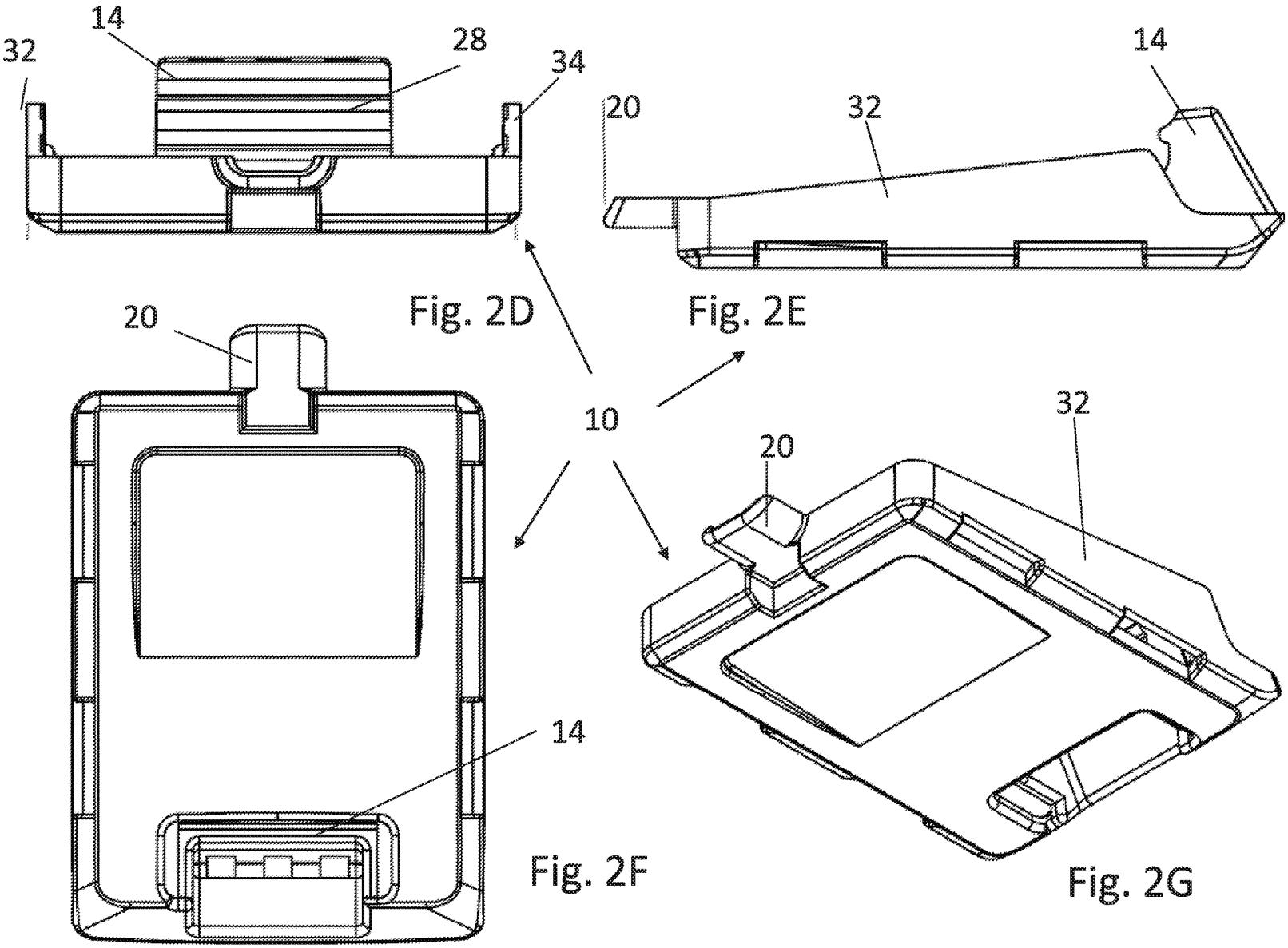

Referring now to the drawings, FIG. 1A illustrates a cartridge for providing even doses of a substance to be applied. In FIG. 1A the cartridge is open. The substance may be any of a powder, a liquid, oil, ointment, emulsion, gel or cream or any other substance for application or more generally any consumable substance, as discussed. FIG. 1A shows the open state before insertion of a liner. FIG. 2A shows the open state from the opposite direction. FIGS. 3A, 3B, 4 and 5A-E show the closed state. The cartridge comprises a base part 10, a leverable upper surface 12 and a stepper mechanism 14. The space between the base and the leverable surface defines a space for a liner to contain the liquid etc to be dispensed. The leverable upper surface 12 is shown in greater detail in FIGS. 1B to 1F. The base part 10 is shown in greater detail in FIGS. 2B to 2G.

A variation may provide uneven doses. It may be desirable with certain substances to provide different sized doses at different times, say large odd numbered doses and small even numbered doses or the like. The variation may be achieved by providing a variable step size in the stepper mechanism.

In an embodiment the liner can be dispensed with and the substance to be applied may be inserted directly into the space. In embodiments, the space may be a sealed cavity/volume where the leverage surface presses down directly onto the gel, liquid, cream etc and squeezes it out.

The levered surface is hinged at a first end to the base part by hinge 16, which may be an integral hinge in some embodiments. In some embodiments, the cartridge is molded as a single part so that the integral hinge is a thinner part of the same material making the rest of the cartridge. With the integral hinge, the leverable surface is downwardly pressable towards the base to restrict the size of the space and squeeze the liner to force liquid etc in the liner to exit from the cartridge. The hinge may be dispensed with in some embodiments and may simply be collapsible. The weakened area may be a tear away region, say extending outwards from the spout.

The stepper mechanism 14 may be located opposite the integral hinge 16 or on one of the sides, and halts the downward motion of the leverable surface at preset intervals corresponding to even doses of the liquid, oil, emulsion, gel or cream, as the steps or teeth 28 catch or lock into the edge of the leverable surface.

Figure 3A:
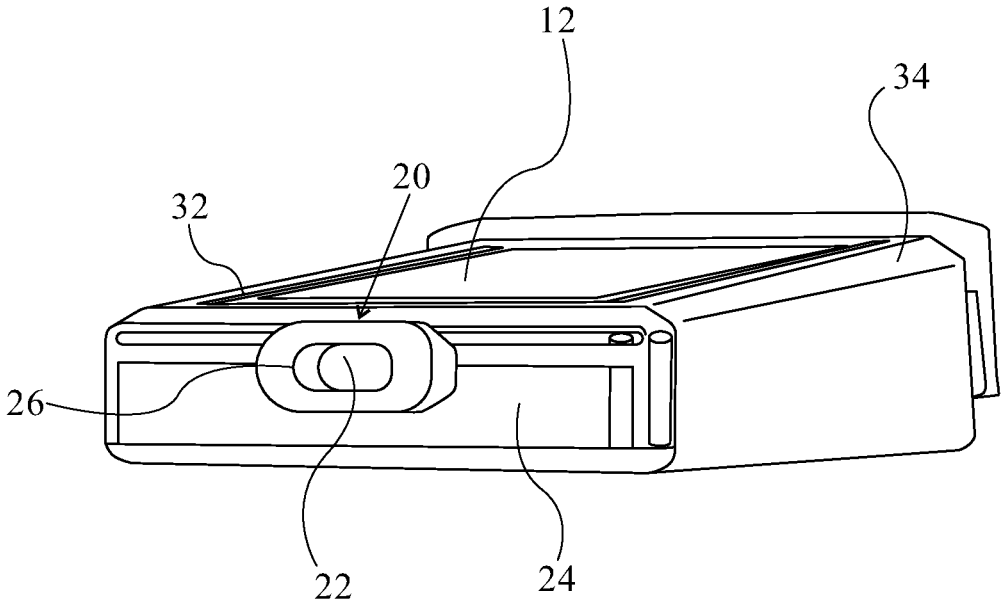
FIG. 3A is a photograph of the cartridge of FIGS. 1A-G in the closed state, which would occur after insertion of a liner.
Figure 3B:
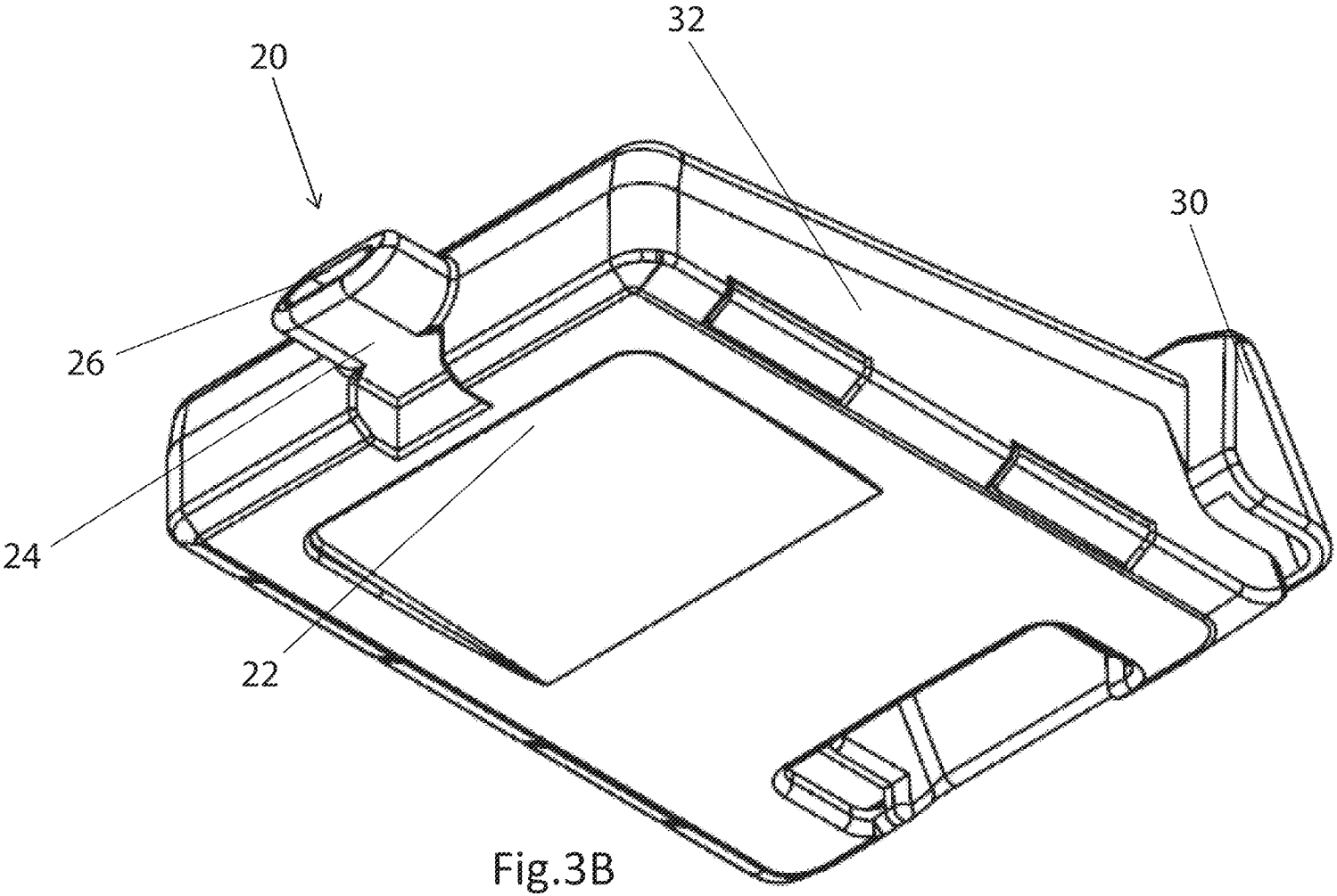
FIG. 3B is a perspective view from below of the cartridge of FIG. 3A.
Figure 4:
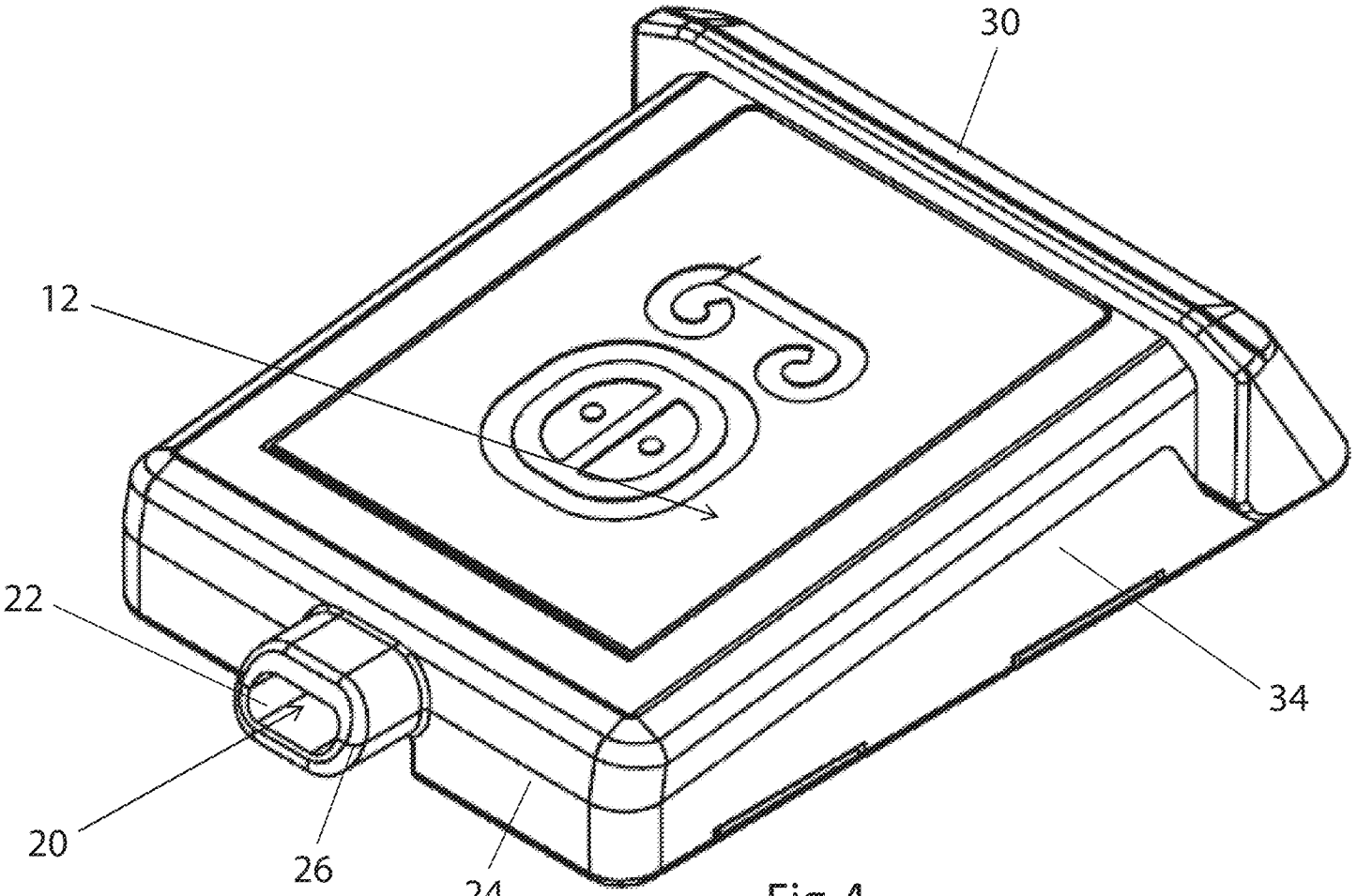
FIG. 4 is a view of the cartridge of FIG. 1B in the closed state in a perspective view from above.
Figure 5A:
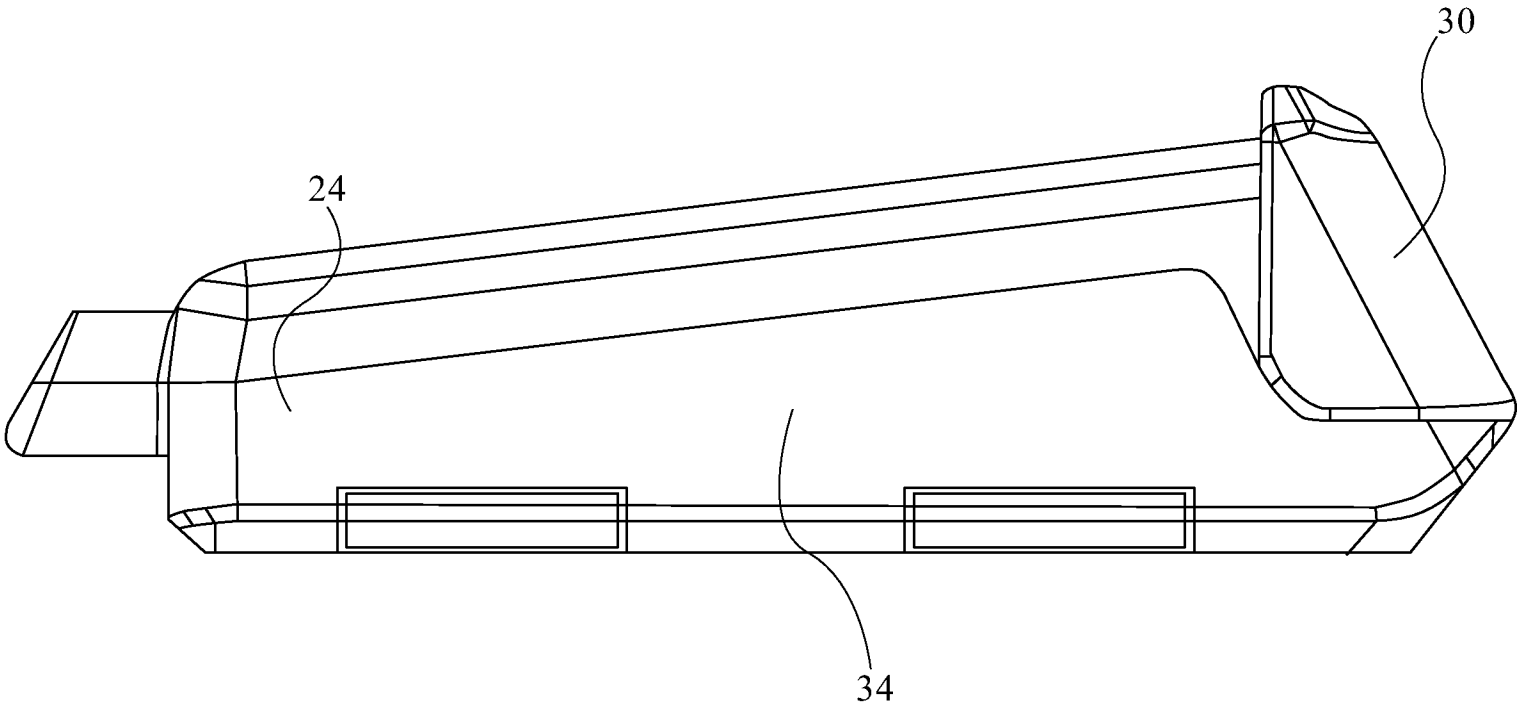
FIG. 5A is a view of the cartridge of FIGS. 1A-G taken from one side.

A spout 20, best viewed in FIGS. 3A-B and 5A, is located between the hinge 16, best viewed in FIGS. 1A and 2A, and the base 10 to direct the exit of the liquid, oil, emulsion, gel or cream onto the user's fingers. The spout 20 may comprise a hole 22 in the cartridge front wall 24 surrounded by a lip 26. The lip 26 typically is flat. In an alternative embodiment, the lip is not flat but rather slopes as it extends radially from the hole so that the thickness of the lip is relatively low at the edge of the hole and relatively large at the outer edge of the lip. The lip may have an upwardly sloping angle. The lip allows the spout to act as a sort of nozzle and direct the liquid towards the fingers. The liner may protrude from the edge or lip of the spout.

The spout may include a one-way valve.

The stepper mechanism 14 has a series of steps or teeth 28. Each tooth extends inwardly from the rear of the cartridge opposite hinge 16. Each tooth catches the edge of the leverable surface 12 as it passes, so making the user have to press to click again.

Here four teeth are shown, but the number of teeth and the gaps in between may define the individual and total dosages.

The cartridge may have rear wall 30 extending downwardly from the upper lever part 12. Sidewalls 32 and 34 extend upwards laterally from the base at opposite sides of the leverable surface 12. The side walls are best viewed in FIGS. 3A-B, extend upwardly beyond the uppermost position of the leverable surface, and thus prevent accidental or unintended pressure causing unintended operation. The leverable surface is connected only by integral hinge 16 and is separate from the side walls 32 and 34. Rear end wall 30 may be mounted either on the base or on the leverable surface. In FIGS. 1A and 2A it is shown mounted on the leverable surface.

The cartridge may be sized to allow the leverable surface 12 to be operated by one or more fingers while the remaining fingers are placed opposite the spout to receive the liquid, oil, emulsion gel or cream. In this way, one handed operation is enabled which allows for use during sports or other activity without requiring the user to stop.

The liner may be sized to fit exactly into the space so that it cannot shift position during use, and the cartridge may be designed correspondingly with shaped corners and with gripping surfaces to hold the liner in position during squeezing.

Figure 5B:
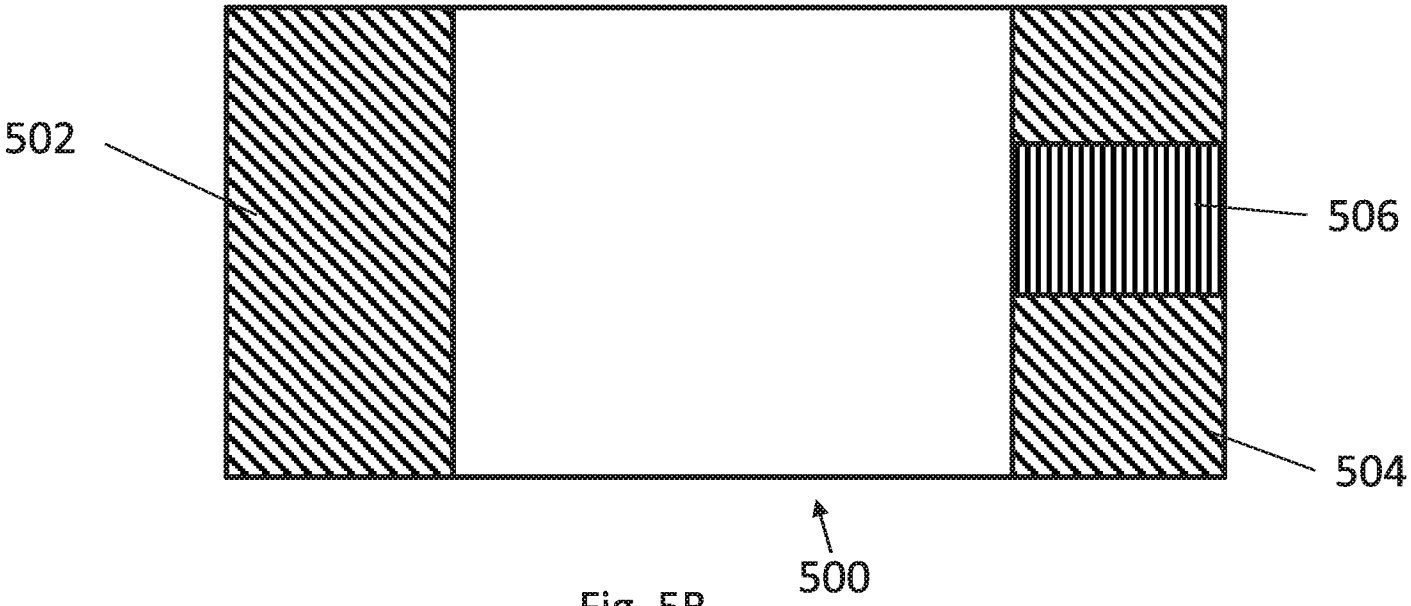
FIG. 5B is a simplified diagram illustrating welding of a liner designed to have a weak point, according to embodiments of the present invention.

Reference is now made to FIG. 5B which illustrates a liner 500 closed by two weld areas 502 and 504 at either end. The weld is formed by carrying out a first application of heat to soft weld the liner and then a second application of heat to seal the liner. Diagonal hatching indicates areas where first and second applications of heat are applied. The liner 500 may have a weak point 506, which is typically placed opposite the spout. The weak point is formed by applying only the first application of heat, and is indicated in the figure by vertical hatching. As the liner is pressed the weak point bursts and thus the user is able to open the previously closed liner.

In alternative embodiments, the weakened point is a protrusion with a weakened weld line. In other embodiments the weakened point may be either one or the other of a protrusion or a weakened weld line, or a portion with a pre-cut. The pre-cut may in embodiments protrude from the spout and be torn away prior to use.

Figures 5C, 5D, 5E:
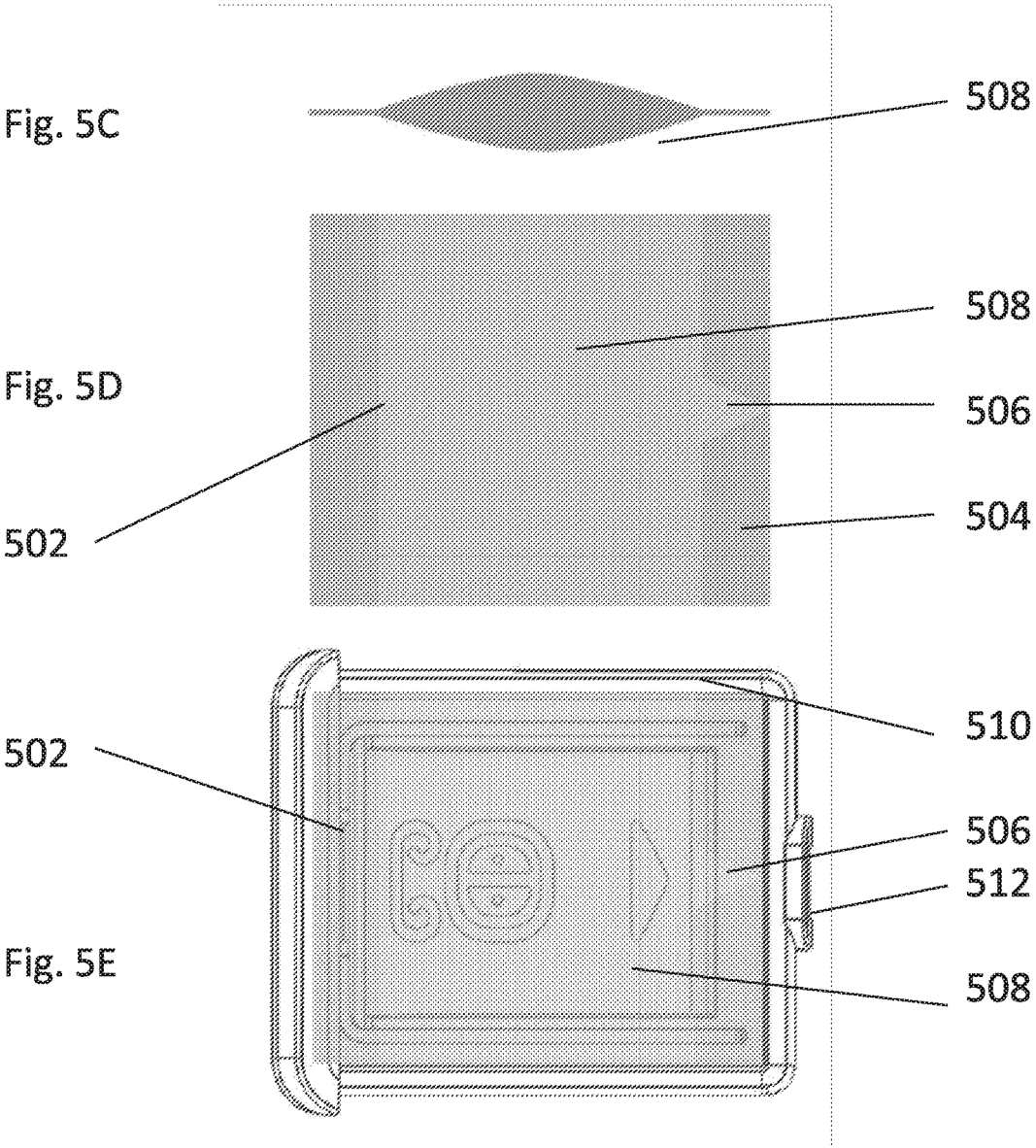
FIG. 5C is a simplified diagram showing a side view of a liner according to embodiments of the present invention.
FIG. 5D is a simplified diagram showing a view from above of a liner and showing a weakened area according to an embodiment of the present invention.
FIG. 5E is a simplified diagram showing the liner of FIG. 5C in a cartridge according to embodiments of the present invention.

Reference is now made to FIGS. 5C, 5D and 5E which show a side view of a liner, a view from above of the liner showing a weakened area and a view of a liner in a cartridge seen from above. FIG. 5C is a side view of a liner 508. FIG. 5D shows the liner from above showing first and second weld areas 502 and 504 to which both applications of heat have been applied. Weakened area 506 has only a single application of heat. FIG. 5E again shows the liner from above but this time within cartridge 510. The liner 508 has first and second weld areas 502 and 504 to which both applications of heat have been applied. Weakened area 506 has only a single application of heat and is shown aligned with spout 512 of the cartridge.

Figures 6, 7A, 7B:
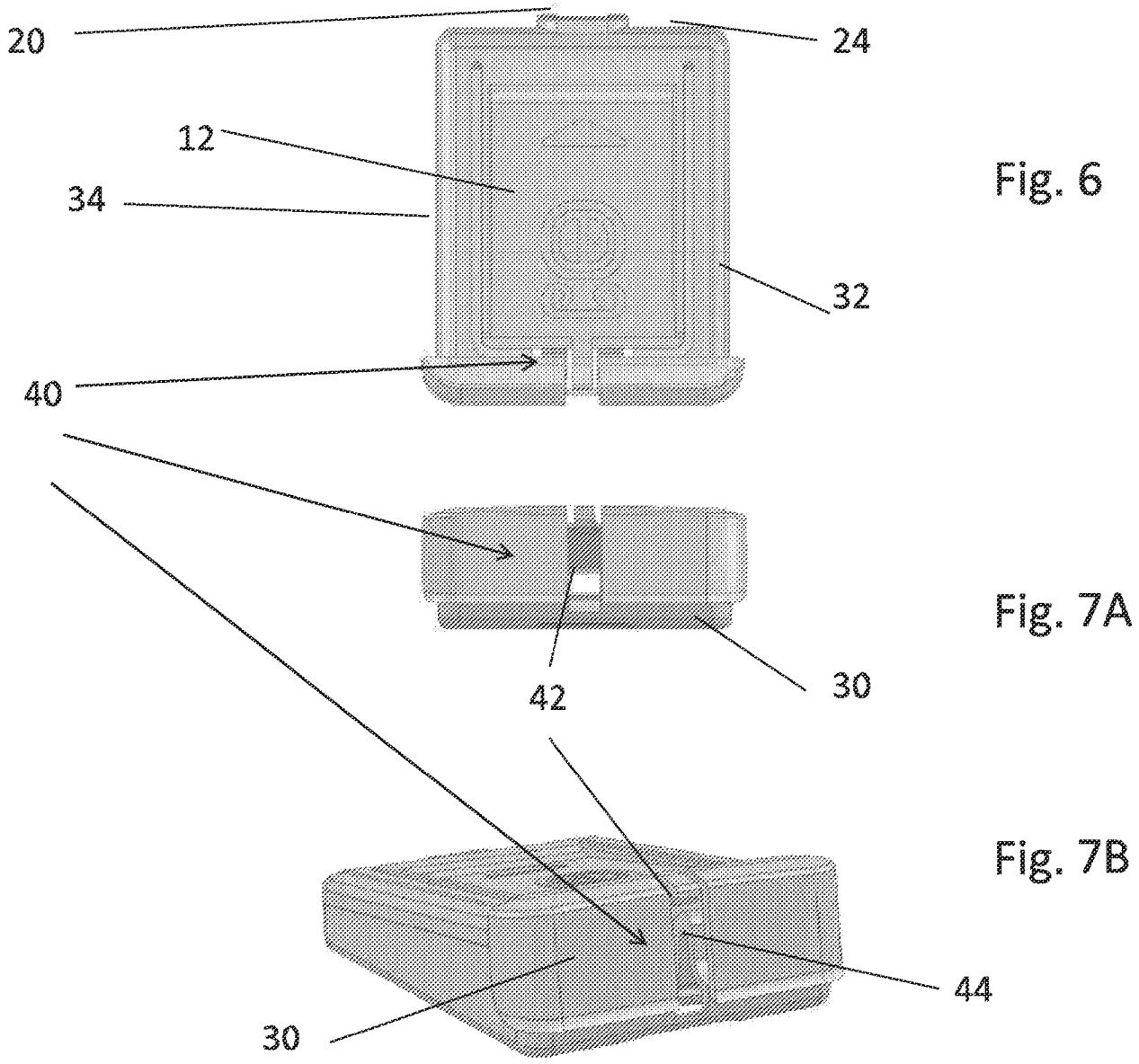
FIG. 6 is a simplified diagram of a cartridge according to a second embodiment of the present invention, including a quantity indicator groove.
FIG. 7A is a simplified diagram showing a rear perspective view of the cartridge outside the cartridge of FIG. 6.
FIG. 7B is a simplified diagram showing a rear perspective view of the cartridge showing the quantity indicator groove of FIG. 6.

Reference is now made to FIGS. 6, 7A and 7B, which are a variation of the embodiment of FIGS. 1A-G. Outer wall 30 opposite the hinge includes an indicator 40 showing a current level of the leverable surface and thus shows the user how many doses remain in the cartridge, or the remaining amount of substance.

The indicator 40 comprises a groove 42 in the outer wall 30. A tab 44 extends outwardly from the leverable surface through the groove to provide the visible indication. The further down in the groove the tab appears the fewer doses remain to be dispensed. The tab may be stylized as shown to increase visibility.

In use, the cartridge may be operated by placing a liner between the base 10 and hinged lever 12. Then the lever 12 is pressed between a first click point and a second click point of the stepper mechanism to squeeze the liquid, oil, emulsion, gel or cream from the liner. The distance between the two click points defines a measured dose.

Initial pressure on the lever punctures a weak point in the liner opposite the spout. When pressed, the lever 12 travels down the full height of the cartridge applying pressure to a soft liner. The full travel is enabled by integral hinge 16 or by other means of controllable collapse.

The spout 20 of the cartridge protrudes slightly to allow alignment of the liner inside the cartridge and to direct the cream or liquid directly to the user's fingertips without coming into contact with the cartridge walls. In certain cases the spout may be lined with Teflon™ or a like substance to decrease friction. The liner may protrude into the spout.

The integral hinge 16, located near the spout 20, allows the lever 12 to travel to the bottom of the cartridge for maximum efficiency.

The plastic edges 32 and 34 of the cartridge are elevated over the top travel position of lever 12 to apply rigidity to the cartridge and prevent accidental dispersing of the cream etc, say due to inadvertent pressing.

The rear 30 of the cartridge is shaped to click in and out of the cartridge efficiently and to lock or click in place stepwise to stop the lever at defined doses. The rear wall 30 may have a stronger plastic profile to provide rigidity to the cartridge and the cartridge.

The protruding fasteners 50 lock the soft liner in position when the rigid outer shell is closed, ensuring alignment of the liner exit point, the weakened point, with the spout and preventing unwanted movement of the liner. Thus, the liner may be retained in position during squeezing. The rear of the liner is positioned below the protruding single dose measurement steps or teeth 28 of the stepper mechanism 14. Once the cartridge is closed and locked in position it cannot be reopened.

Four single dose measurement steps or teeth 28 are located at the back of the cartridge. As mentioned above, the number four is merely exemplary. The teeth each catch the lever as it descends to stop squeezing at a defined position indicating that the requisite dose is completed. Additional pressure needs to be applied to push the lever on to the following tooth and the next dose. Once the lever has cleared the last step it is caught at the bottom and cannot move any more, indicating to the user that the cartridge is empty.

The hard outer shell may in some embodiments be produced using a single mold, and may provide an integral hinge and fasteners. In other embodiments, two parts are manufactured separately and snapped together.

Figure 8D:
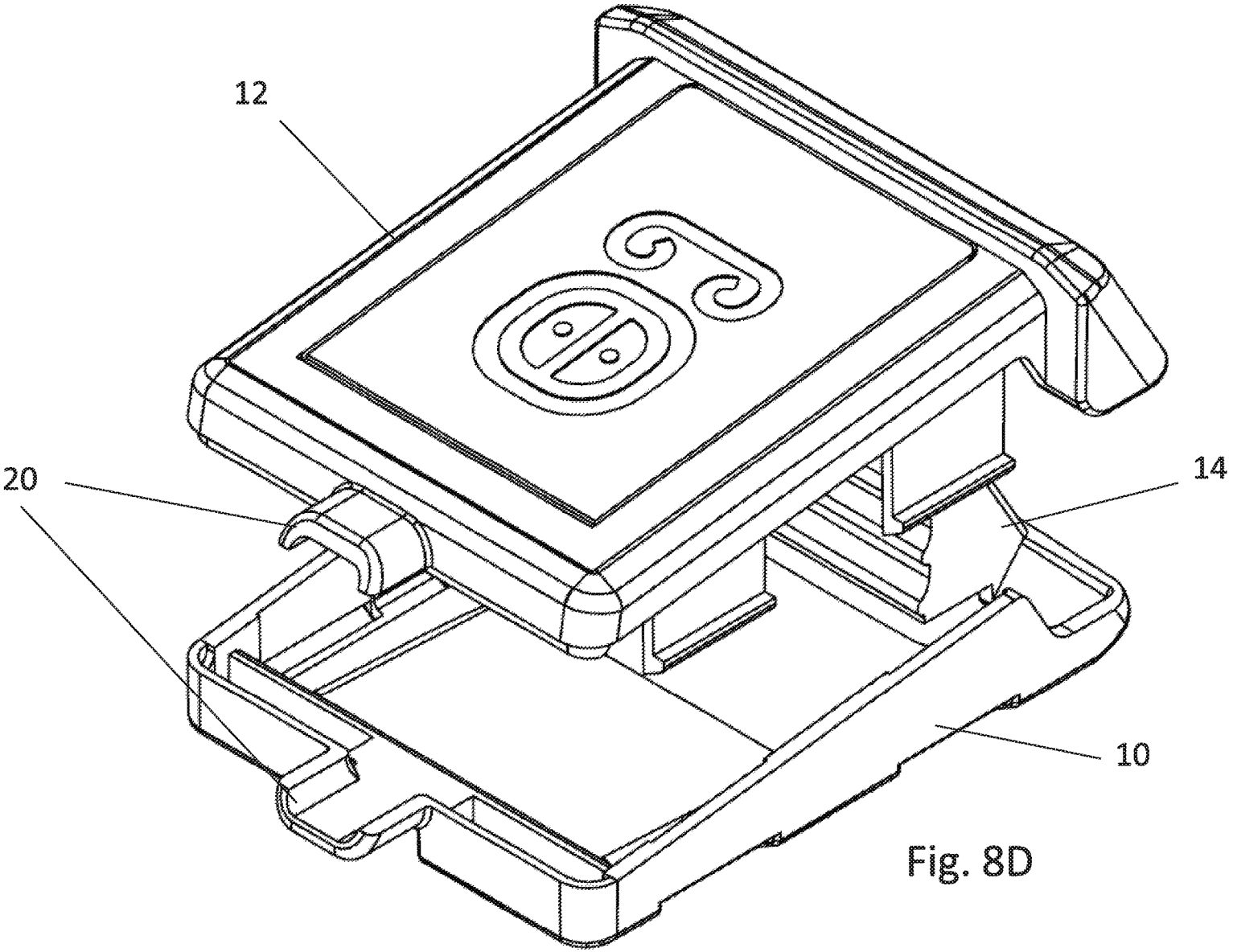

Reference is now made to FIGS. 8A to 8D, which illustrate upper 12 and base 10 parts as shown in the previous embodiments being fitting together. FIG. 8A shows base member 10 from above, and stepper mechanism 14 is visible. FIG. 8B is a view from one end which shows lever member 12 above base member 10. FIG. 8C is a side view showing lever member 12 above base member 10. FIG. 8D is a perspective view from above of lever member 12 above base member 10.

Figure 9C:
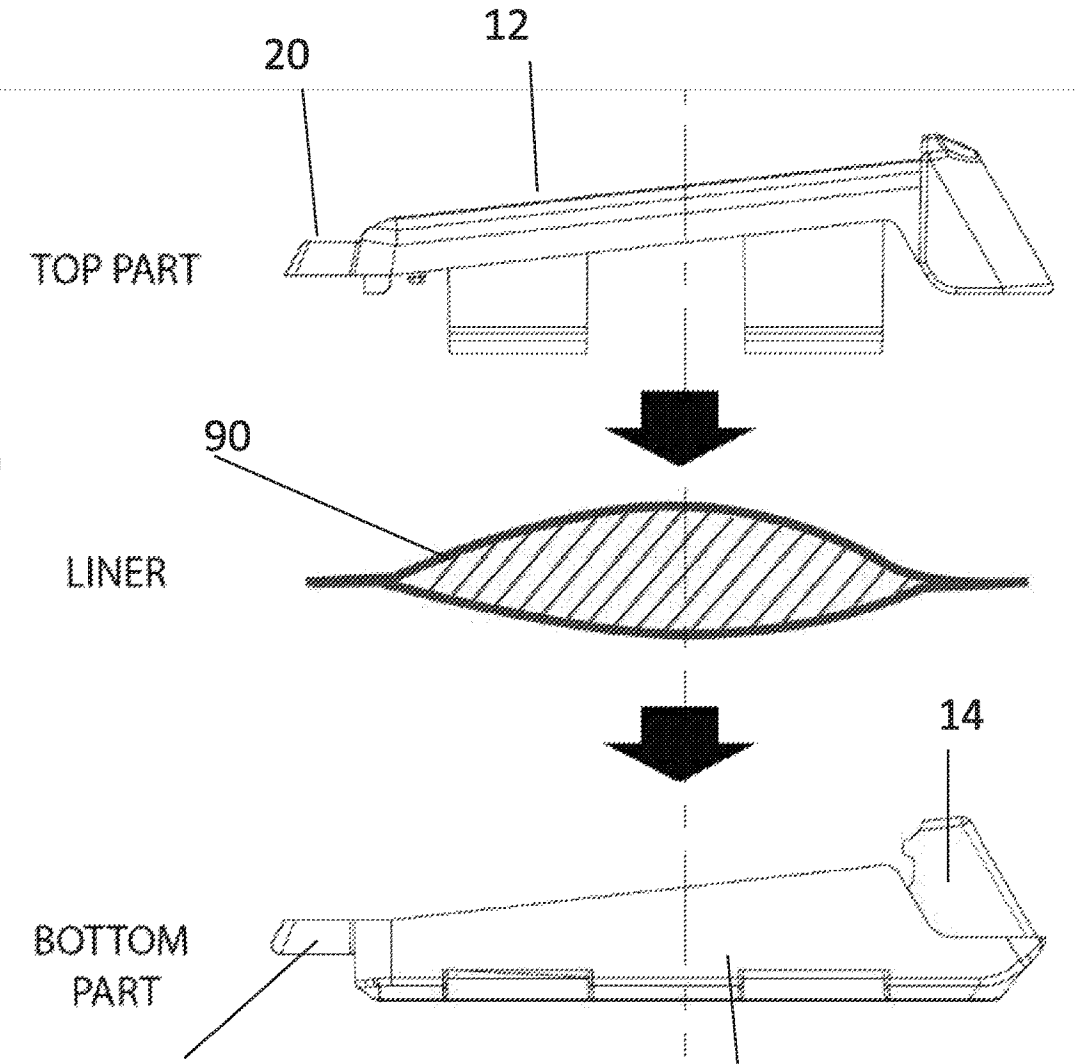
FIGS. 9B and 9C are views from different angles of a liner between upper and lower cartridge parts waiting to be snapped together according to an embodiment of the present invention.
Figure 9B:
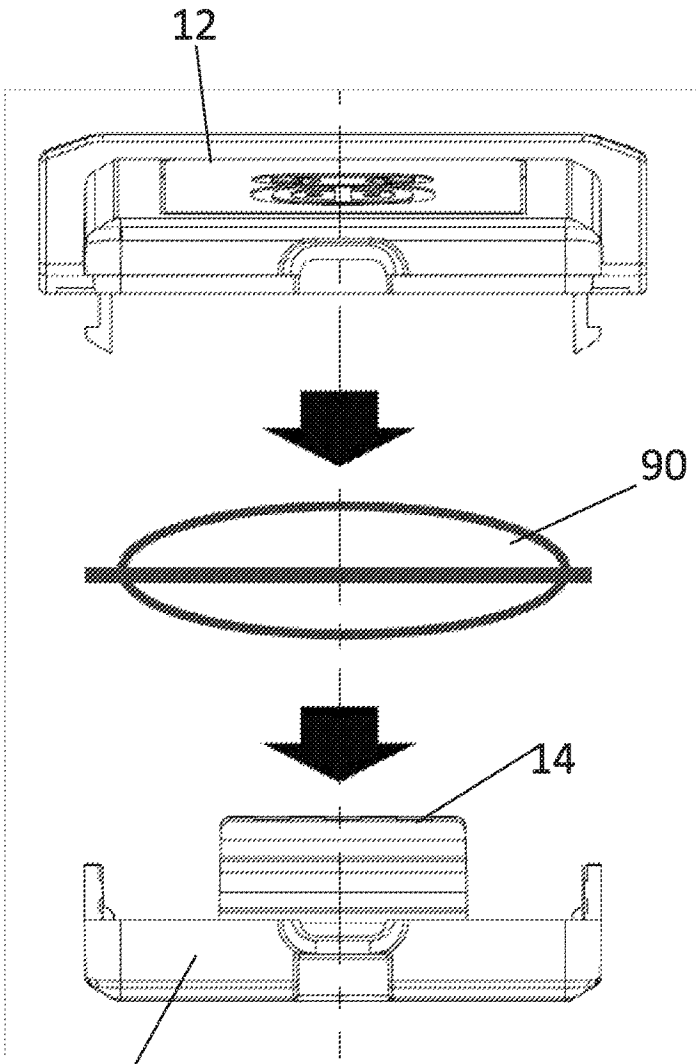

Reference is now made to FIGS. 9A to 9C, which are different cross-sectional views of the cartridge enclosing a liner 90. FIG. 9A shows a cross sectional view of the cartridge with a full liner. FIG. 9B shows the top part 12 and bottom part 10 ready to be snapped in position over liner 90. FIG. 9C shows a side view of the top part 12 and bottom part 10 ready to be snapped in position over liner 90.

Figure 9D:
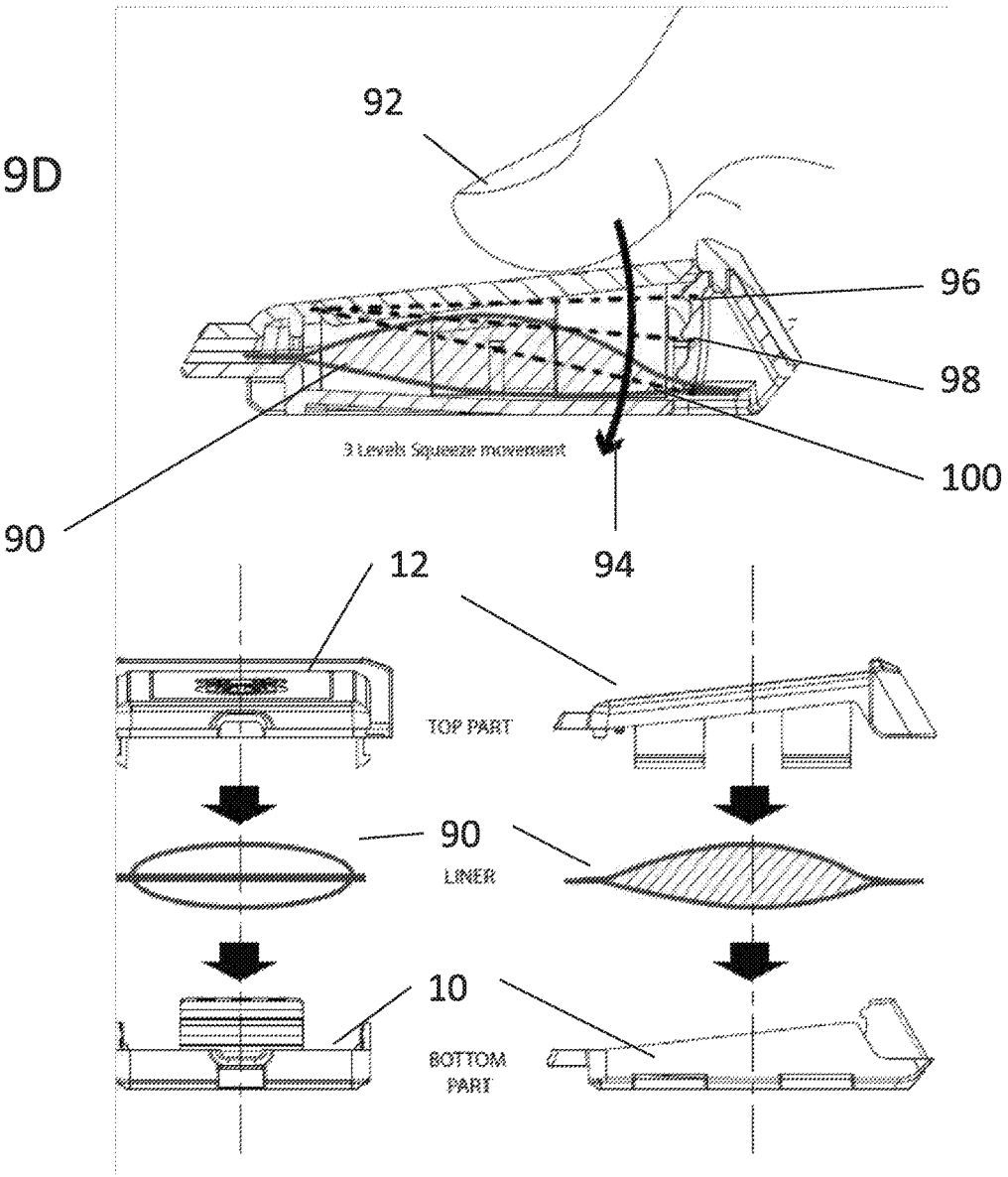
FIG. 9D is a simplified diagram showing successive positions of the lever as it presses against the liner according to embodiments of the present invention.

FIG. 9D illustrates different positions of pressing of the liner 90 within the cartridge 60. As finger 92 presses down on lever surface 12, the lever surface passes stepwise through the stepping arrangement 14, at each step squeezing the liner 90 a measured amount more, and progressing in the direction of arrow 94 so that the lever advances over the positions illustrated by dotted lines 96, 98 and 100 until all of the substance is squeezed out of the liner.

Figures 10, 11A:
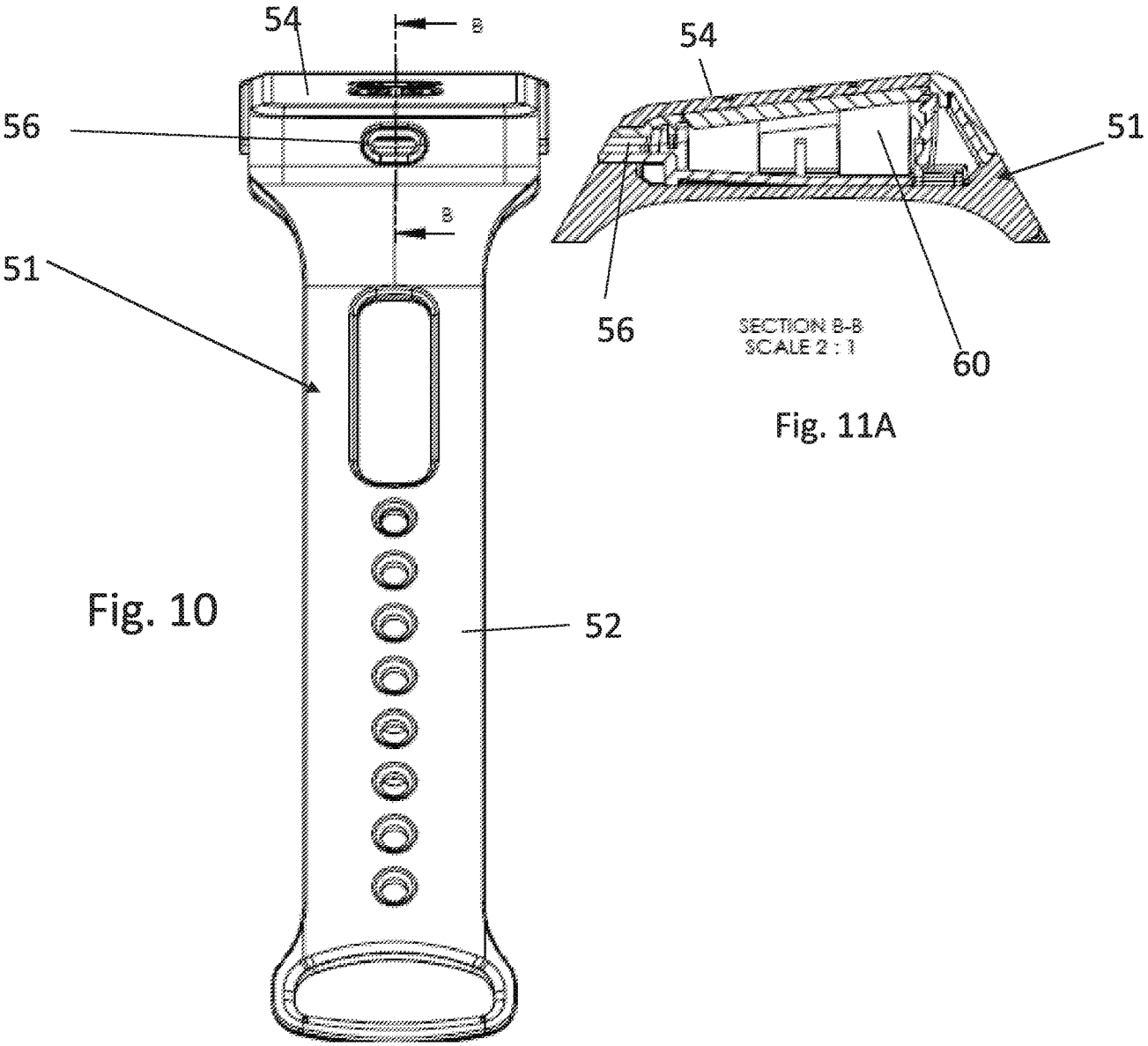
FIG. 10 is a simplified diagram showing a wrist-strap type carrier for a cartridge according to embodiments of the present invention.
FIG. 11A is a cross-sectional view showing the cartridge of FIG. 10 within the carrier according to embodiments of the present invention.
Figure 11B:
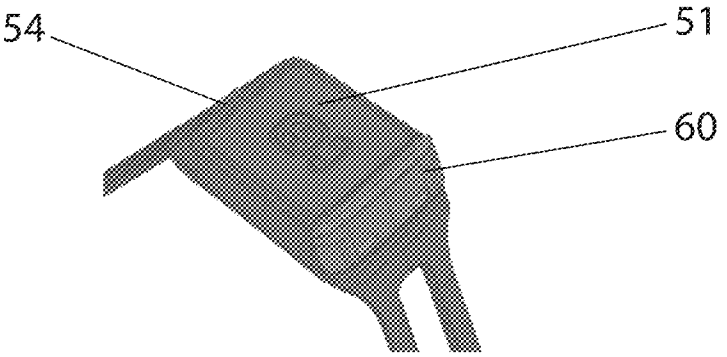
FIGS. 11B and 11C are simplified diagrams of the carrier of FIG. 11A for the cartridge of the present embodiments, wherein the cartridge is inserted and before insertion respectively and wherein the carrier is designed for fitting on a wrist.
Figure 11C:
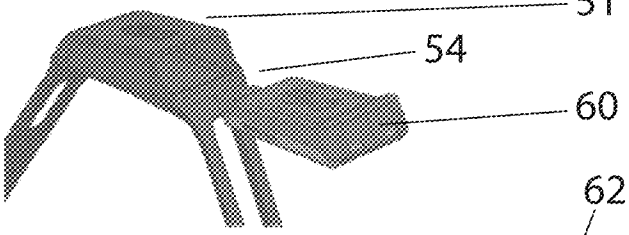
Figure 12:
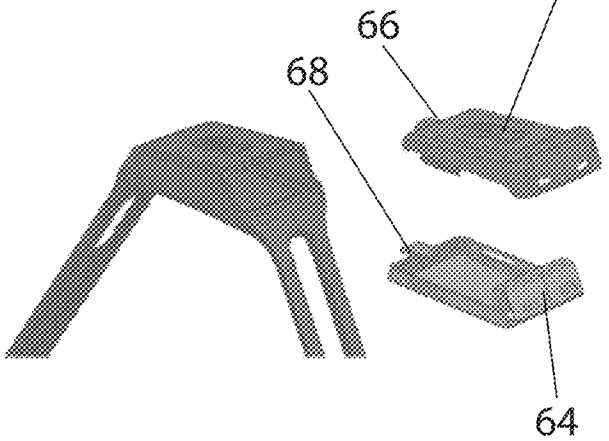
FIG. 12 illustrates the embodiment of FIGS. 11A to 11C prior to fitting together of the upper and lower parts of the cartridge.
Figure 13:
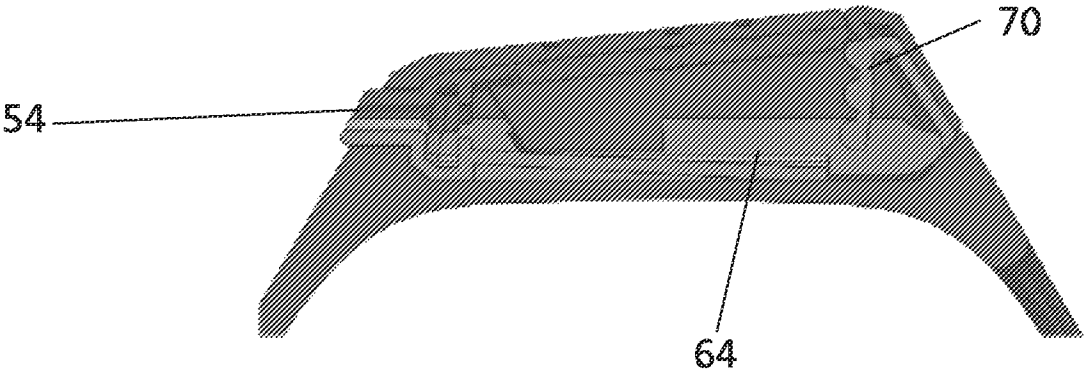
FIGS. 13 and 14 are cross-sections of the cartridge of FIG. 10 from within the wristband.
Figure 14:
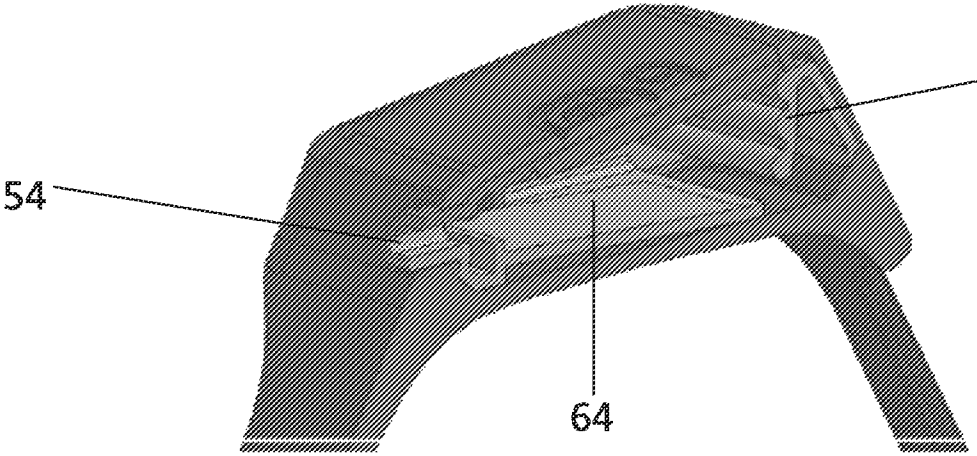

Reference is now made to FIGS. 10-17B, which illustrate a further embodiment of the dispensing cartridge. The cartridge may be standalone, or it may be placed within a carrier. FIG. 10 illustrates a side view of an example of such a carrier. FIG. 11A illustrates a perspective view of the carrier in the form of a watch strap and FIG. 11B shows the carrier of FIG. 11A with the cartridge 60 inserted. FIG. 11B shows the cartridge 60 prior to insertion into the carrier and FIG. 12 shows the cartridge 60 as separate upper and lower parts prior to insertion of the liner. FIGS. 13 and 14 are a cross-sectional view of the cartridge within an exemplary carrier. As shown in FIG. 10, a carrier 51 is provided with straps 52 for fitting over a user's wrist or the like. The user presses top surface 54 of the carrier, typically a soft surface, which in turn presses on the lever on the inside of the cartridge to dispense the application substance via spout 56.

Returning to FIG. 12 and there is shown a diagram showing upper 62 and lower 64 parts of the cartridge, respectively having upper 66 and lower 68 parts of the spout 54. Spout 54 is part of the cartridge and extends through a corresponding hole in the carrier 51. The spout 54 is shown to extend through the carrier 51. In an embodiment, rounded edges may be provided on the internal wall of the carrier to ensure that the cartridge does not slip during use.

The upper and lower parts form a two part design. The liner is placed between the two parts and then the two parts may be closed over the liner with two clicks and cannot then generally be opened by the user. Clamp edges at the sides clamp the liner in position, to prevent it from changing positions during the squeezing process. The liner is thus kept in alignment, and ensuring smooth dispensing.

FIGS. 13 and 14 are cross-sections of the embodiment of FIG. 10, showing the stepped back surface 70 of the lower part 64 of the cartridge 60.

FIG. 15 shows the upper 62 and lower 64 parts of the cartridge and showing the stepped wall 70 of the lower part 64, and the upper 66 and lower 68 parts of the spout. FIG. 16 is a view of the upper 62 and lower 64 parts from the back, and FIG. 17 is a perspective view of the upper and lower parts.

Figure 18:
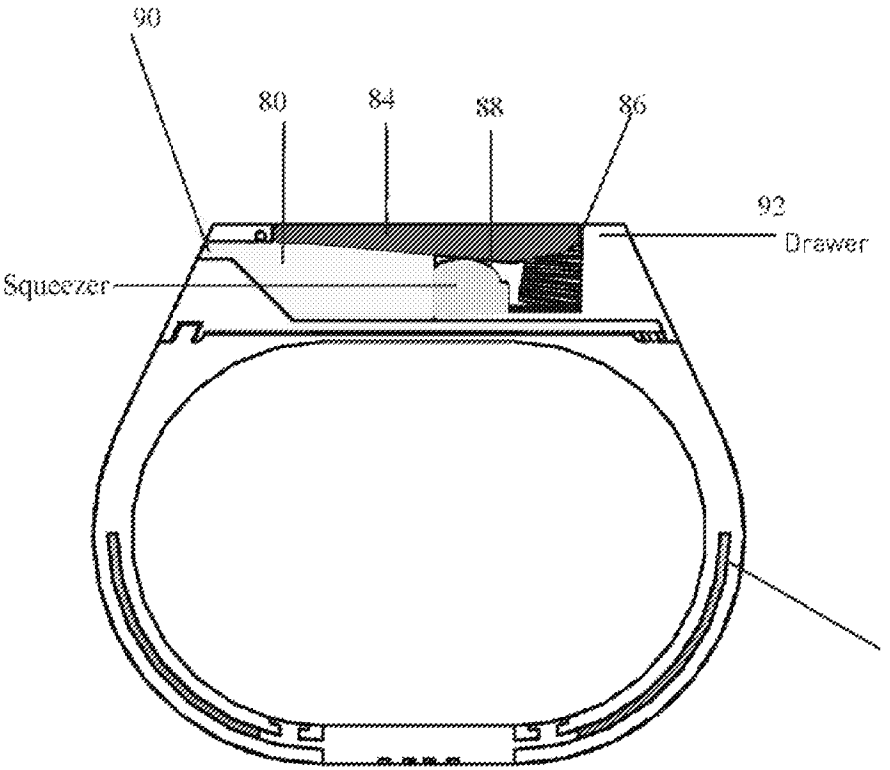
FIG. 18 illustrates an additional embodiment of the present invention in which the ratchet mechanism is on the carrier rather than on the cartridge.

Reference is now made to FIG. 18, which illustrates a further embodiment of the present invention, in which cartridge 80 simply dispenses the application substance, and the pressing and dosage mechanisms are provided by the carrier 82. Carrier 82 includes a lever 84 which operates against a resilience 86 such as a series of steps or a ratchet. The lever operates to move a squeezer element 88 which in turn presses against the cartridge 80 to dispense application substance view the spout 90. The cartridge is restrained by the space defined by cartridge drawer 92 in which the cartridge is contained, and each press moves the lever by one step or ratchet position to dispense a single dose.

Figure 19:
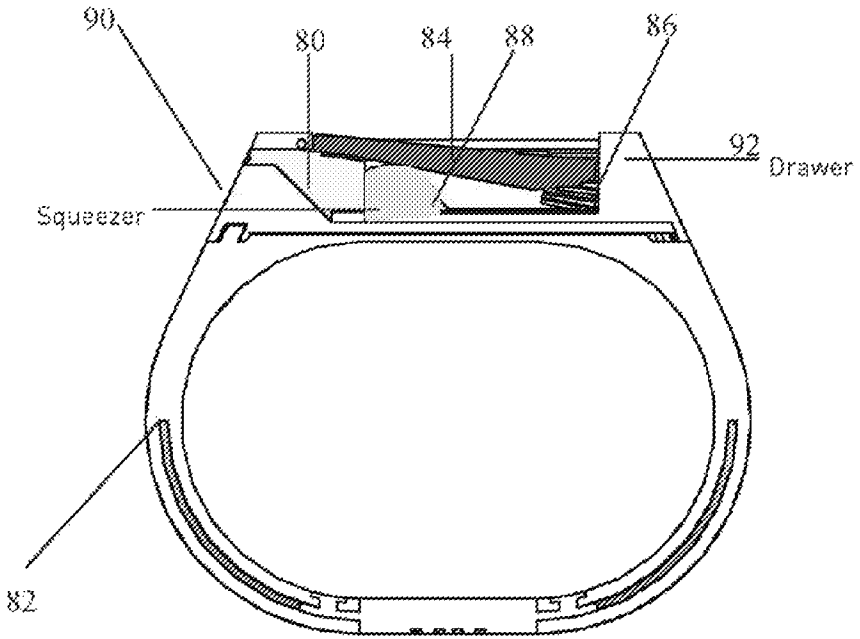
FIG. 19 illustrates the embodiment of FIG. 18 after pressing of the dispensing lever.

FIG. 18 shows an initial position and FIG. 19 shows a later position as the carrier has been squeezed to some extent.

Figure 20:
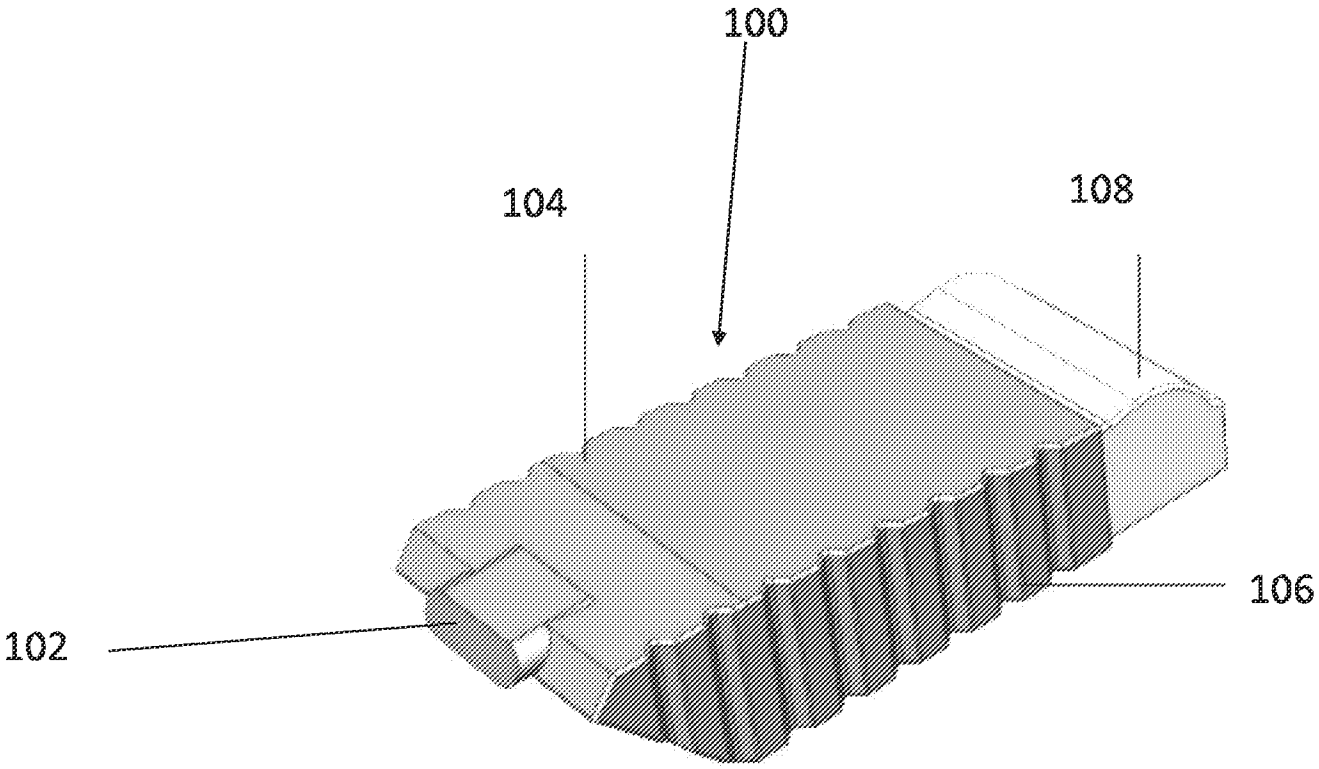
FIG. 20 shows a first cartridge for use with the embodiment of FIG. 18 in which pleats for collapsing the cartridge are transversely arranged on the cartridge.

FIG. 20 illustrates a cartridge 100, suitable for use with the mechanism of FIG. 18. Cartridge 100 includes spout 102 for dispensing. A substance holding chamber 104 has pleated walls 106 for easy collapse to dispense the substance. A rear chamber 108 allows for smooth application of pressure and the outside thereof may provide the squeezer 88.

Figure 21:
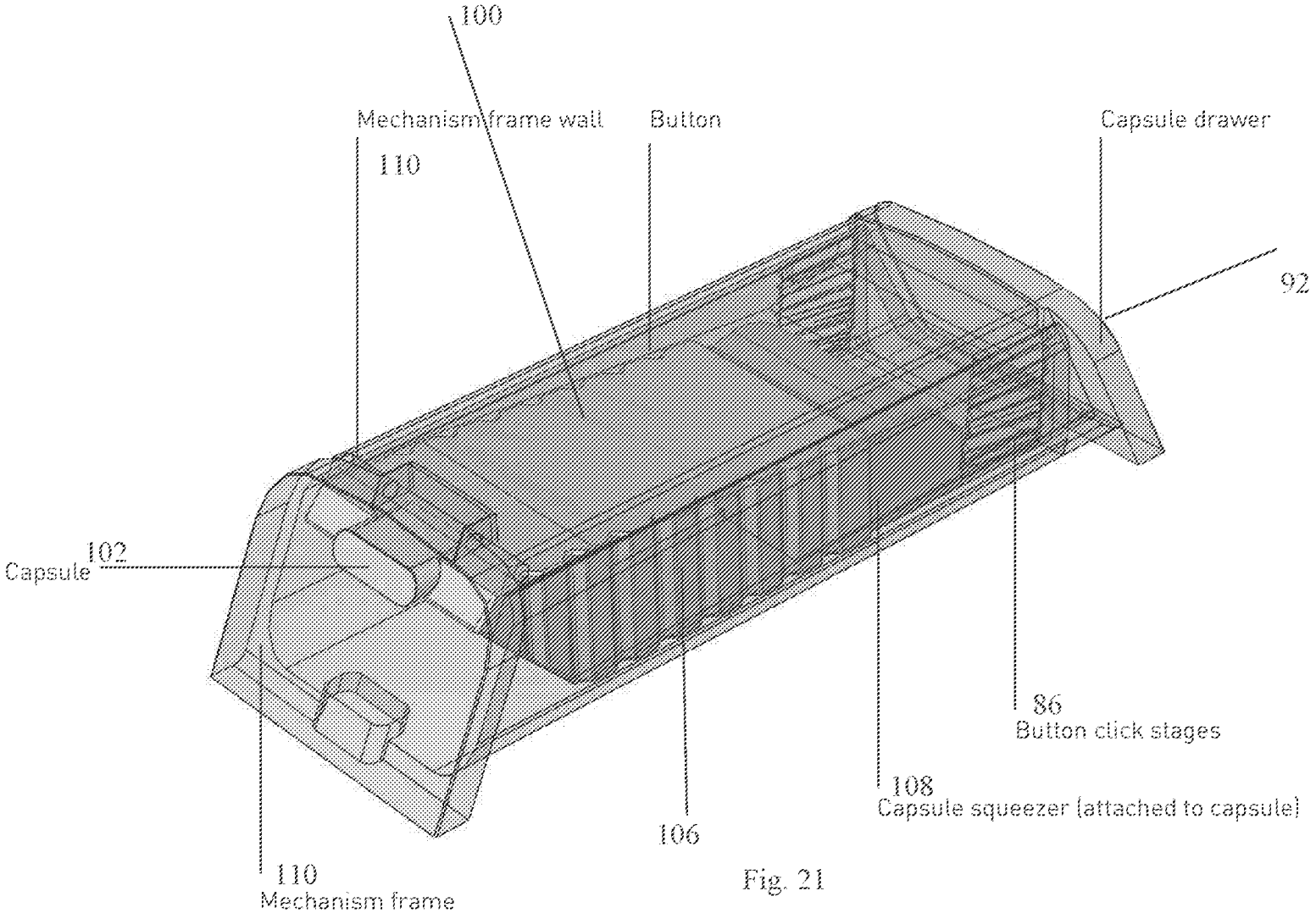
FIG. 21 illustrates the cartridge of FIG. 19 arranged within the carrier of FIG. 18.

FIG. 21 illustrates the cartridge 100 inside the cartridge drawer 92 of FIG. 18. A mechanism frame 110 provides a reaction surface at the front of drawer 92 against which the cartridge 100 is squeezed following pressing of button 112, to push the lever against the steps of ratchet 86. The carrier 82 may provide a silicone waistband to hold the mechanism, and tall side walls may protect the mechanism from accidental presses, as in previous embodiments.

FIG. 22 shows perspective and side views of the mechanism of FIG. 18. Lever 120 may be pressed to advance along the steps of ratchet 86 and then returns to its original position.

Figure 23:
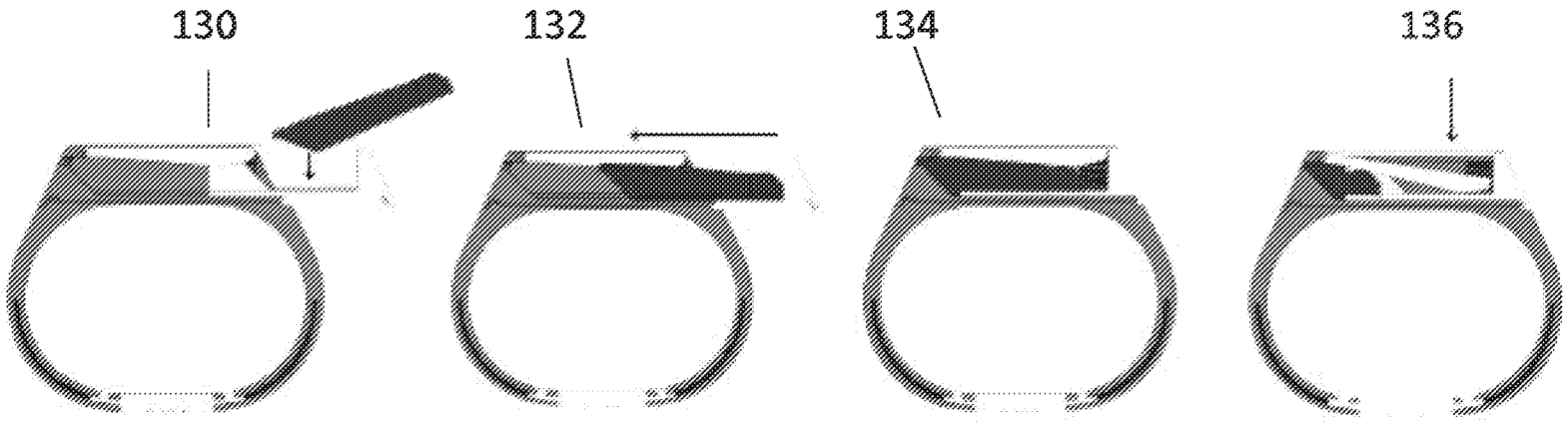
FIG. 23 illustrates four successive positions of the dispensing mechanism from insertion of the cartridge to dispensing the substance.

Reference is now made to FIG. 23, which illustrates four stages of inserting the cartridge 130, closing the drawer, 132, the drawer closed with cartridge full, 134 and the cartridge after squeezing, 136.

Figure 24:
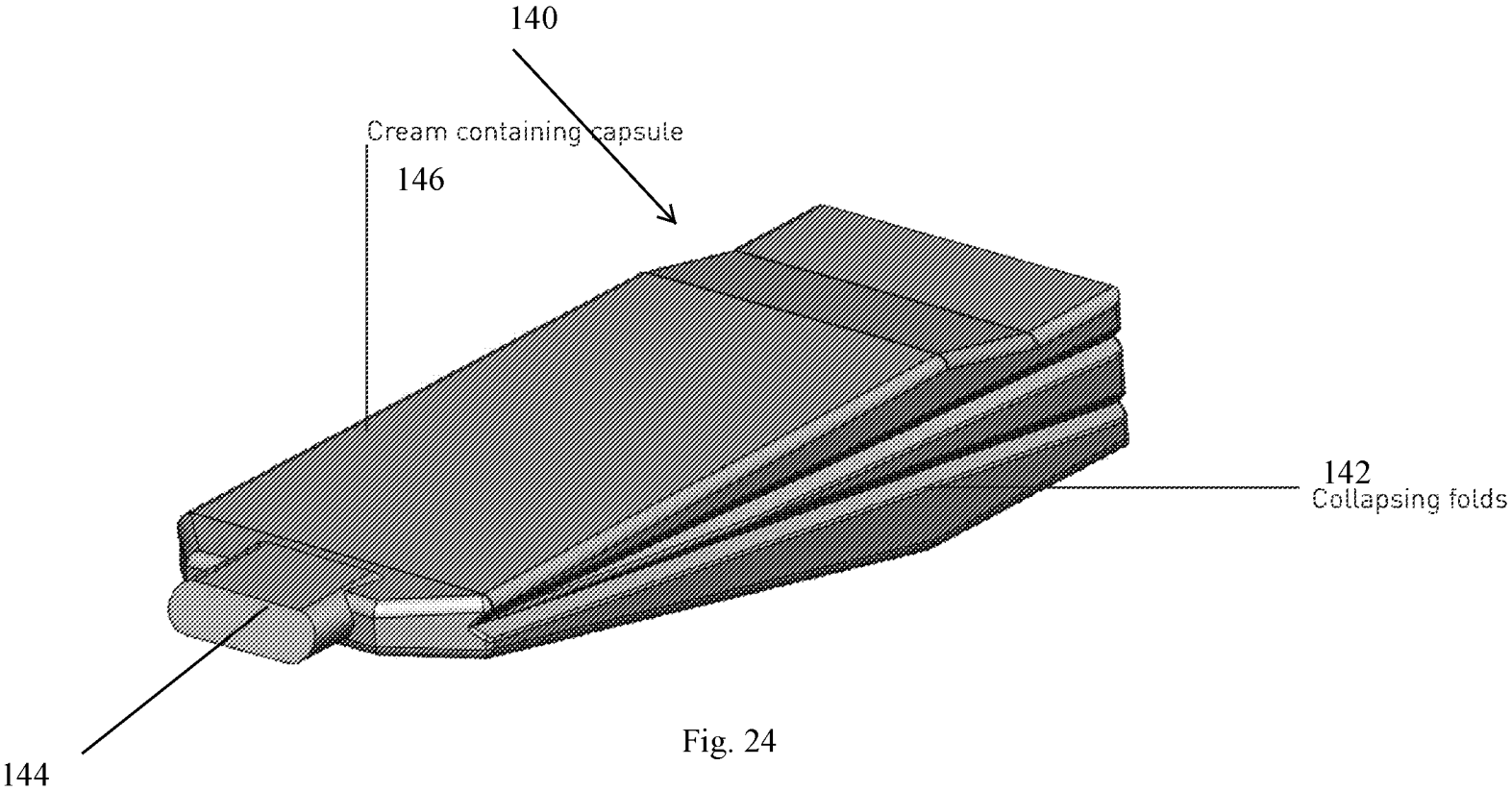
FIG. 24 illustrates an alternative cartridge for use with the mechanism of FIG. 23 in which the pleats are along the longitudinal direction of the cartridge.

Reference is now made to FIG. 24, which is shows an alternative embodiment 140 of a cartridge in which the collapsing folds 142 are along the longitudinal direction of the cartridge. As before there is an extending spout 144 and a containing region 146.

Figure 25:
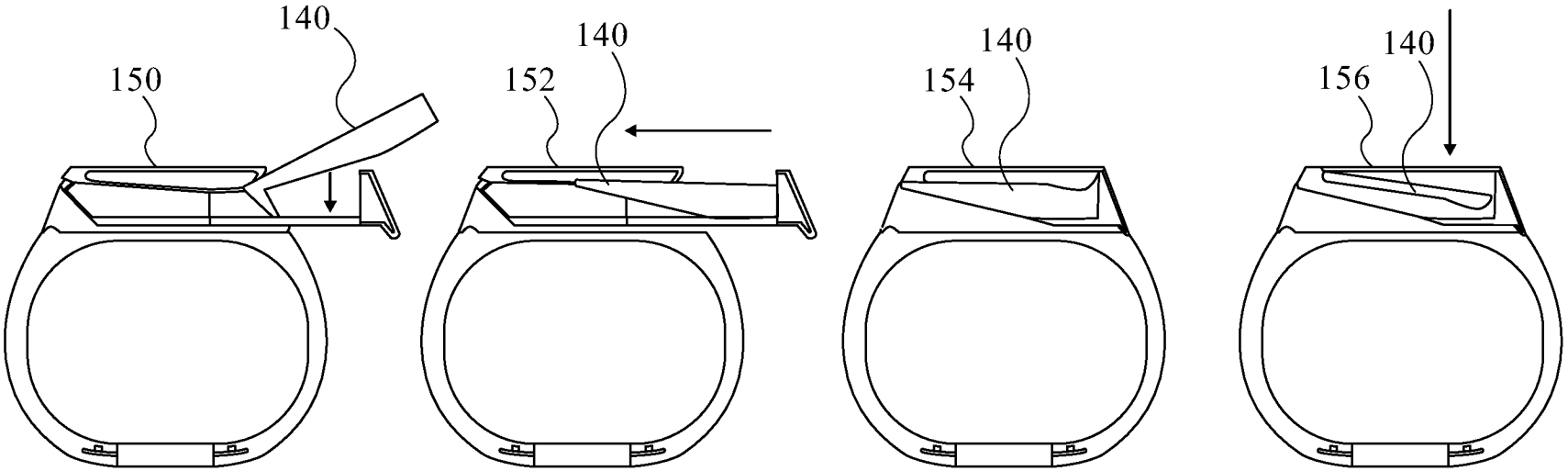
FIG. 25 illustrates four successive positions of the dispensing mechanism with the cartridge of FIG. 24, from insertion of the cartridge to dispensing the substance.

The cartridge is inserted in the same way into the mechanism. FIG. 25 illustrates the stages of pressing the cartridge. In 150 the cartridge is inserted into the open drawer. In 152 the drawer is closed. In 154 the cartridge is ready and full in the closed drawer. In 156, the cartridge is pressed from above by the lever, so that the cartridge is pressed down to the floor instead of towards the front of the drawer as in the previous embodiment.

Figure 26B:
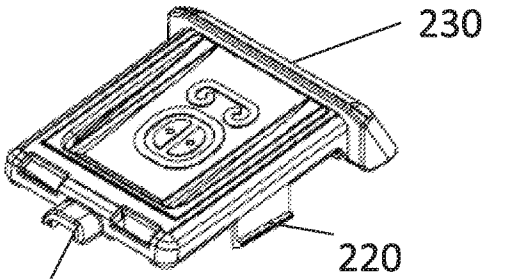
FIGS. 26A-26N illustrate a further embodiment of the cartridge and showing the upper part, the lower part and the combination of the two parts to form the cartridge.
Figure 26D:
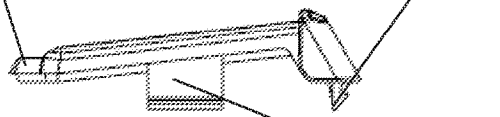
Figure 26A:
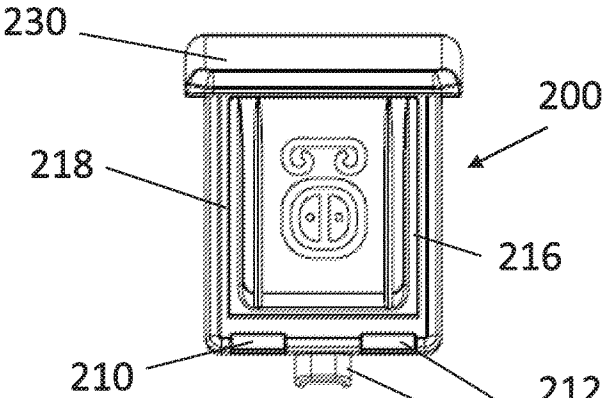
Figure 26C:
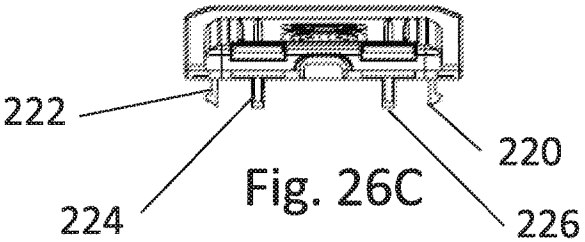
Figure 26E:
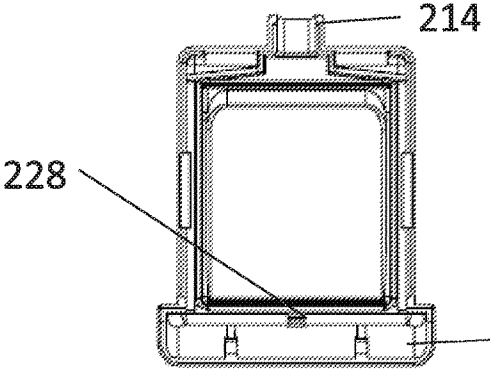

FIGS. 26A-26N illustrate a further embodiment of the cartridge. FIGS. 26A to 26E show upper part 200 of the cartridge, having two location holes 210 and 212 in the front part adjacent spout 214. Reinforcing strips 216 and 218 are provided on the upper surface to provide strength at the edges of the lever to squeeze effectively. Location lugs 220, 222, 224 and 226 are provided for snap fitting onto the lower part 202. Additional location hole 228 is provided at the top of cover 230 to locate the stepper mechanism.

FIGS. 26F to 26J show the lower part 202. Two location lugs 240 and 242 extend from the front side 244 on either side of spout 246 to locate into location holes 210 and 212.

The presence of location lugs on the lower part 202 may allow for more accurate positioning of the liner. Stepper location lug 248 locates into additional location hole 228.

FIG. 26K is a cutaway view of the cartridge from the side. The upper and lower parts 200 and 202 slope into each other towards the front 250. Such sloping allows for the lever to more efficiently squeeze out material. In addition the lever has a concave shape 252 at the front, which likewise allows for more efficient utilization of the material.

FIGS. 26L to 26N show perspective, side and front views of the combination of the upper 200 and lower 202 parts ready to be snapped together to form the full cartridge.

A liner (not shown) is located on the lower part 202 and then the upper part is snapped onto the lower part to construct the cartridge.

Figure 27:
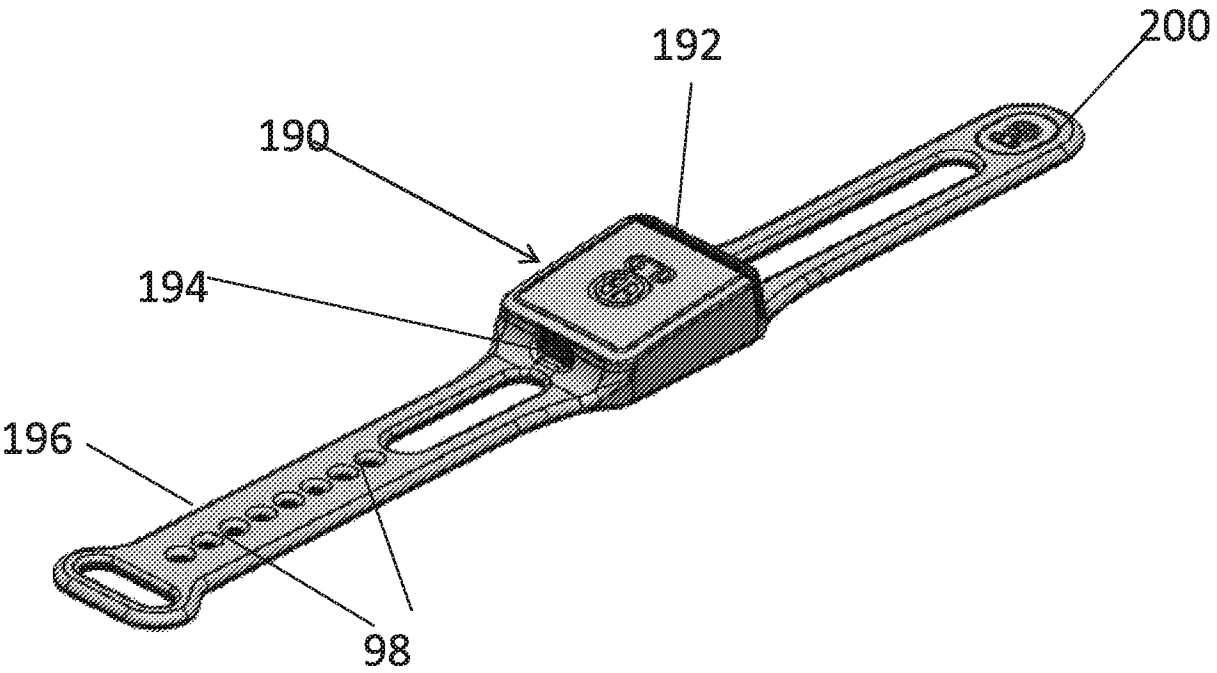
FIG. 27 is a perspective view of a carrier with dispenser inserted and equipped with a wrist strap according to an embodiment of the present invention.

Reference is now made to FIG. 27, which is a simplified embodiment showing carrier 190 with dispenser 192 inside. Dispenser 192 can be seen protruding from the back of the carrier. When squeezed, liquid exudes from opening 194 in the carrier housing, which coincides with a spout of the dispenser. The carrier is attached to strap 196 which is designed for attachment at the wrist. The strap 196 has adjustment holes 198, and a buckle 200.

Figure 28:
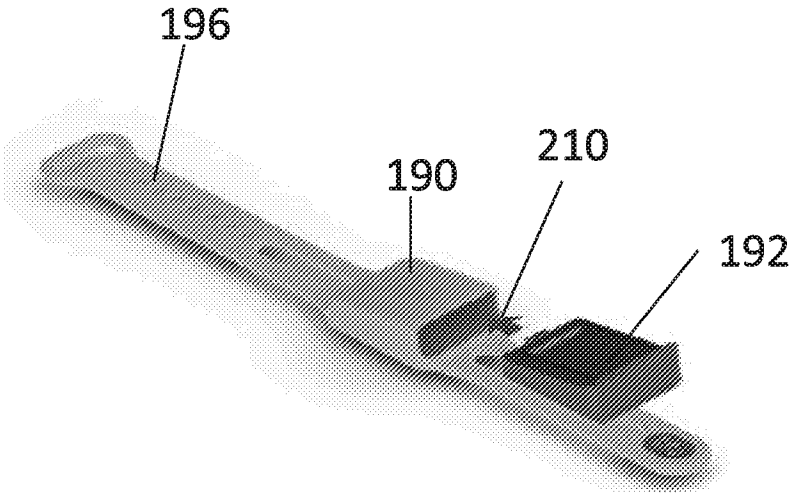
FIGS. 28 and 29 illustrate the embodiment of FIG. 27 before and after insertion of the dispenser into the carrier respectively and shown from different angles with respect to FIGS. 11 and 12.
Figure 29:
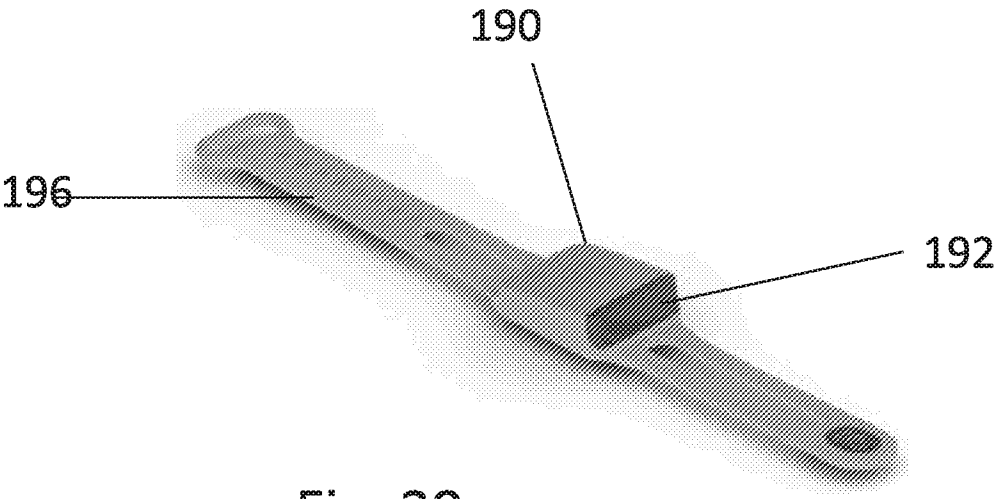

FIG. 28 shows the carrier 190 with strap 196. The dispenser 192 is outside and is inserted through the open end of the carrier housing in the direction of arrow 210. FIG. 29 shows the dispenser inserted.

Figure 30:
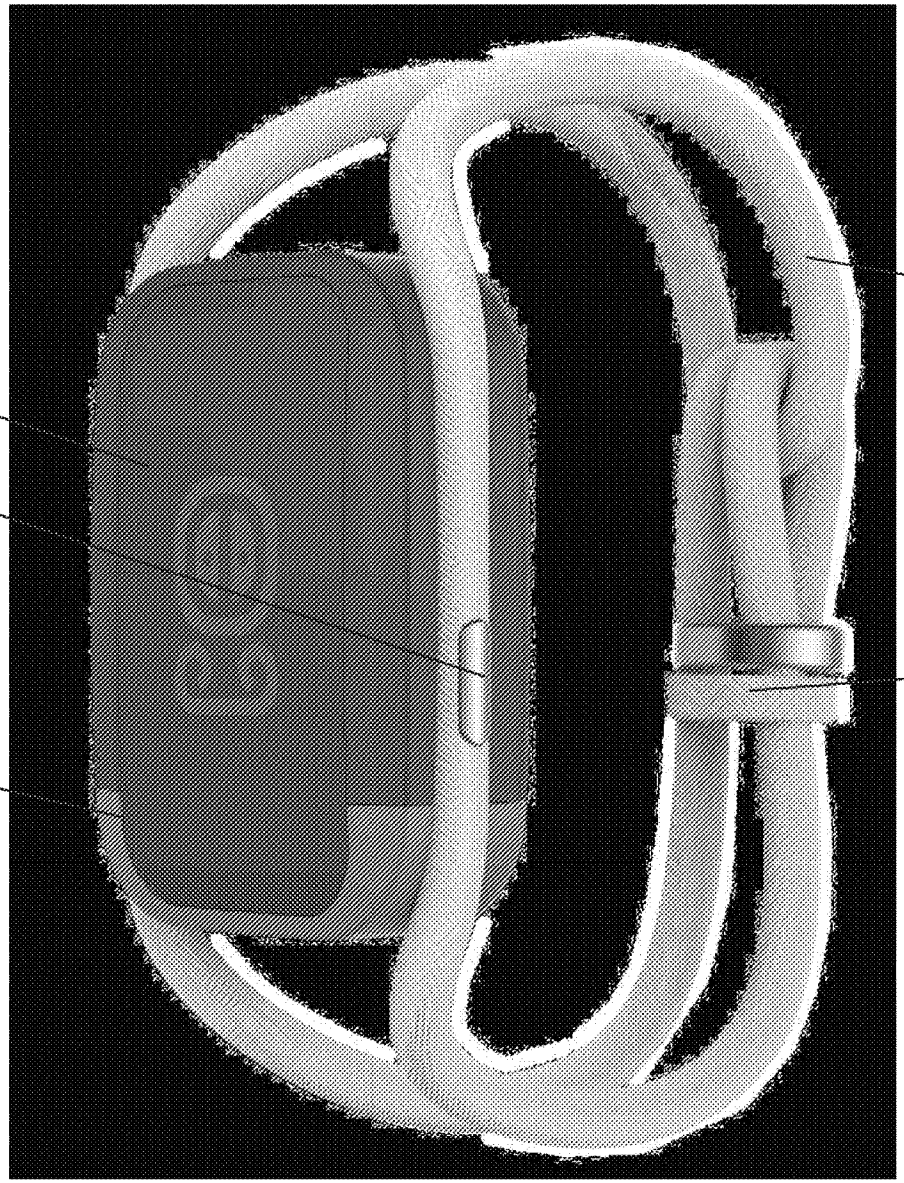
FIG. 30 shows a carrier with dispenser inserted and with a different strap, according to another embodiment of the present invention.

Reference is now made to FIG. 30, which shows an alternative embodiment of the carrier and of the attachment. Carrier 220 contains dispenser 222 which, as before protrudes from one end. The carrier is held by a loop of cord 224 which is attached to the carrier on either side by brackets 226. The cord includes a buckle adjustment 228.

Figure 31C:
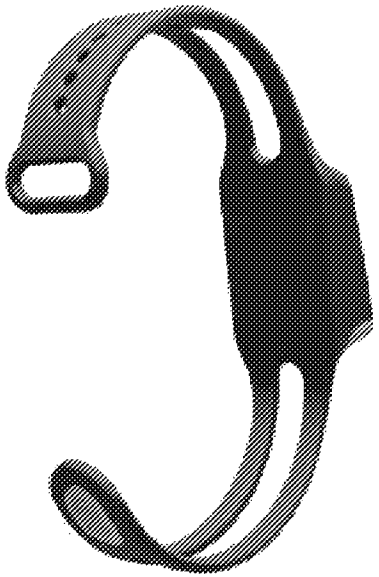
FIGS. 31A to 31C show different views of the carrier of FIG. 27 with the dispenser inserted.
Figure 31B:
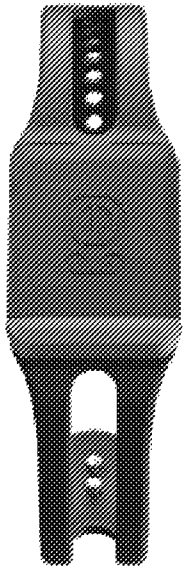
Figure 31A:
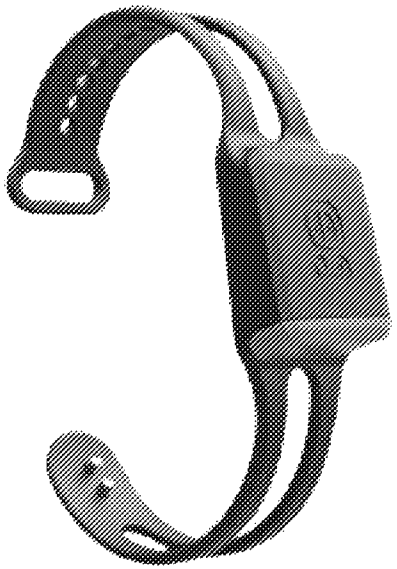

FIGS. 31A, 31B and 31C are front perspective, view from above and rear perspective views of the carrier, dispenser and strap of FIGS. 27-29.

Wrist straps or wrist bands may include a child's wristband, or an adaptor for a watch.

Figure 32A:
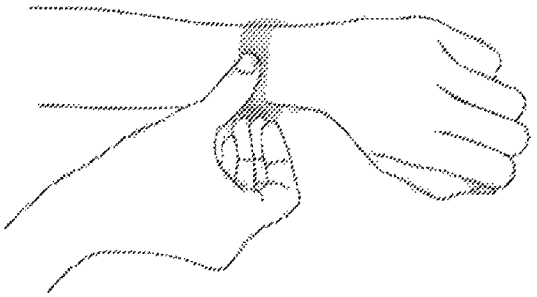
FIGS. 32A to 32C illustrate different ways of wearing a device on a wristband according to the present embodiments.
Figure 32B:
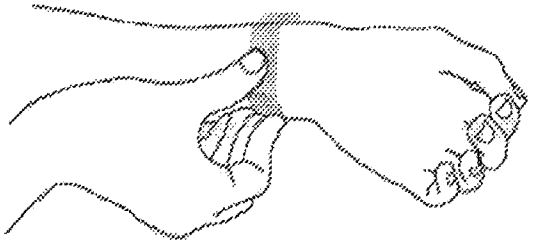
Figure 32C:
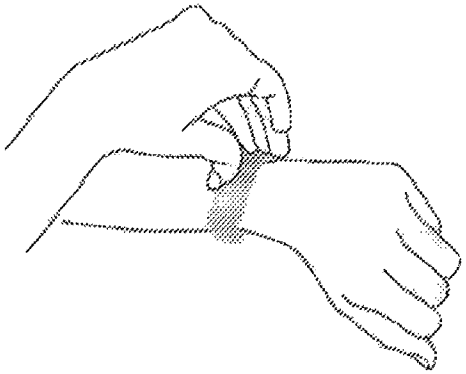

Reference is now made to FIGS. 32A, 32B and 32C which show respectively how the cartridge can be operated on the wrist. As shown in FIG. 32A the button is pressed into the wrist and inwards. In FIG. 32B the button is pressed downwardly onto the lower side of the wrist and in FIG. 32C the button is pressed inwardly from the outside of the writs.

Figure 33A:
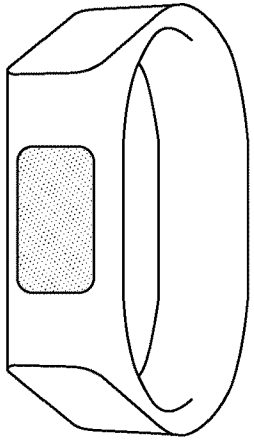
FIGS. 33A to 33C illustrate different locations for buttons, refills and insertions, according to embodiments of the present invention.
Figure 33B:
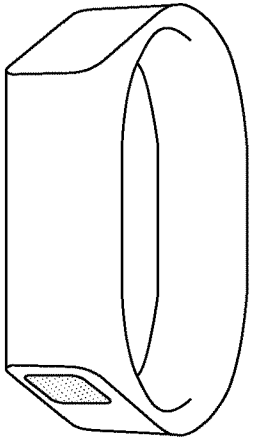
Figure 33C:
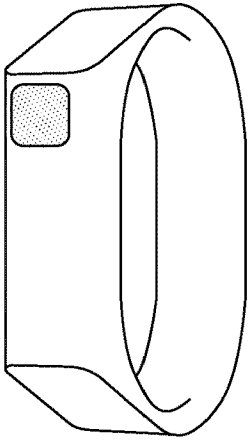

Reference is now made to FIGS. 33A, 33B and 33C, which show locations for different operating buttons. An upper position over the cartridge, as shown in FIG. 33A, is suitable for pressing the cartridge to squeeze out the substance. FIG. 33B shows a location on the side for loading the cartridge, and FIG. 33C shows a suitable location for an indicator, say for example indicating how full the cartridge is.

Figures 34, 35, 36, 37, 38:
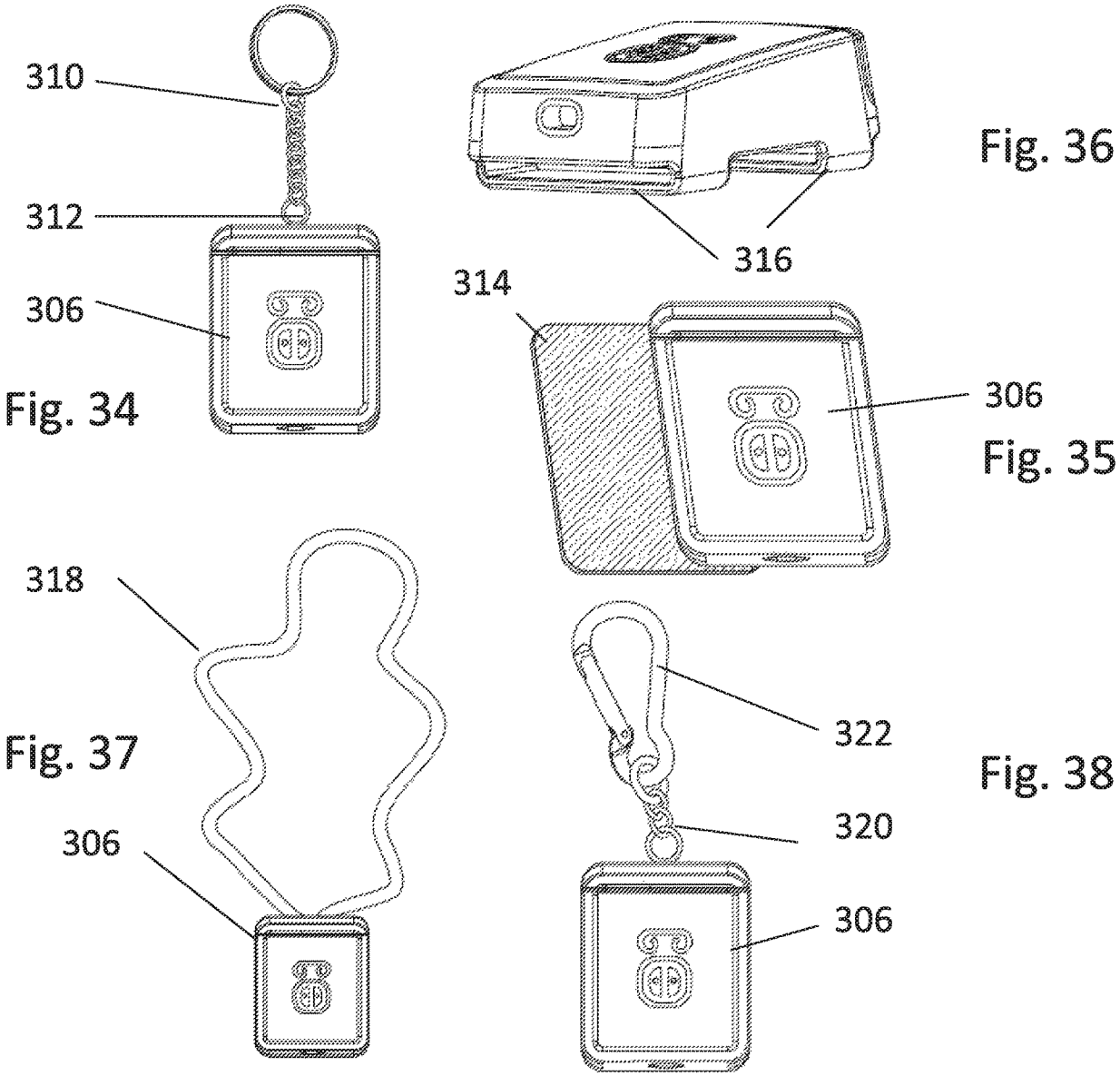
FIG. 34 illustrates the carrier attached to a key chain according to an embodiment of the present invention.
FIG. 35 illustrates a carrier attached to a piece of material, for example a tape or Velcro™, according to an embodiment of the present invention.
FIG. 36 illustrates a carrier with links through which a tongue of material can be threaded, for example a wrist strap or a bag strap according to an embodiment of the present invention.
FIG. 37 illustrates carrier held by a necklace 318 according to an embodiment of the present invention.
FIG. 38 illustrates a carrier held to a belt clip according to an embodiment of the present invention.

FIG. 34 illustrates the carrier 306 attached to a key chain 310 via a link 312.

FIG. 35 illustrates carrier 306 attached to a piece of material 314 such as Velcro™ or like material. The use of such material allows the carrier to be attached to textiles in general and clothing and backpacks in particular.

FIG. 36 illustrates a carrier 306 with links 316 through which a tongue of material can be threaded, for example a wrist strap. The carrier can be inserted onto straps of an existing wearable product, for example onto a watch, including a sports watch, so that the user does not have to wear two sets of straps.

FIG. 37 illustrates carrier 306 held by a necklace 318.

FIG. 38 illustrates carrier 306 held by chain 320 to belt clip 322.

Figure 39:
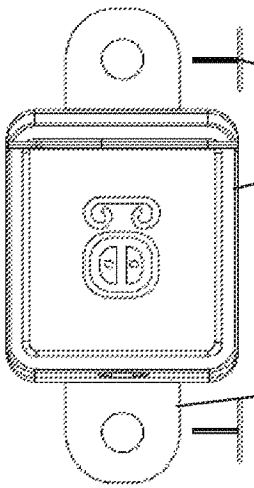
FIG. 39 illustrates a carrier attached to a strap through which screws can be used to attach as necessary, according to an embodiment of the present invention.

FIG. 39 illustrates a carrier 306 attached to a strap 324 through which pins 326 can be used to attach as necessary. Alternatively the strap 324 can be stitched onto clothing etc.

Figure 40:
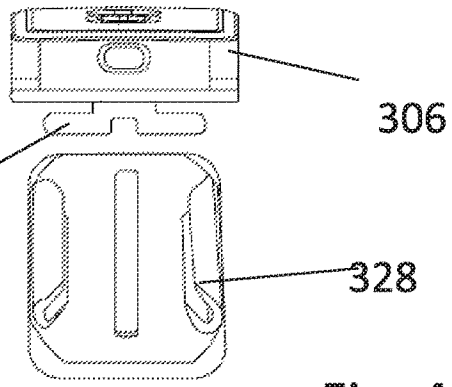
FIG. 40 illustrates a carrier that slots into a platform according to an embodiment of the present invention.

FIG. 40 illustrates carrier 306 that slots into platform 328 via opening leg 330.

Figure 41:
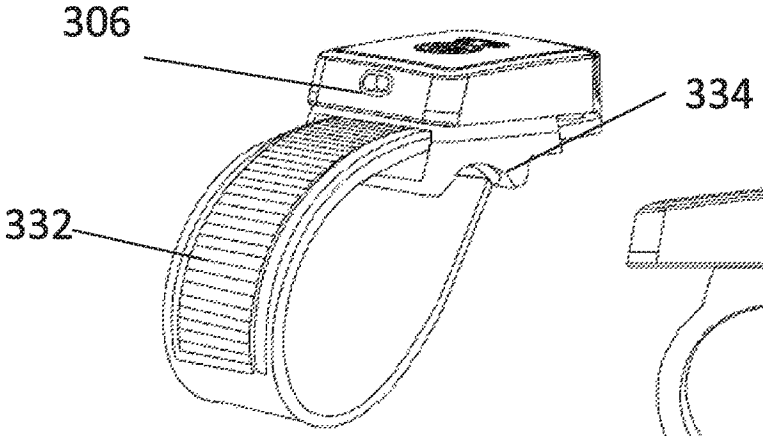
FIG. 41 illustrates a strap threaded through loops according to an embodiment of the present invention.

FIG. 41 illustrates a strap 332 threaded through loops 334 under carrier 306.

Figure 42:
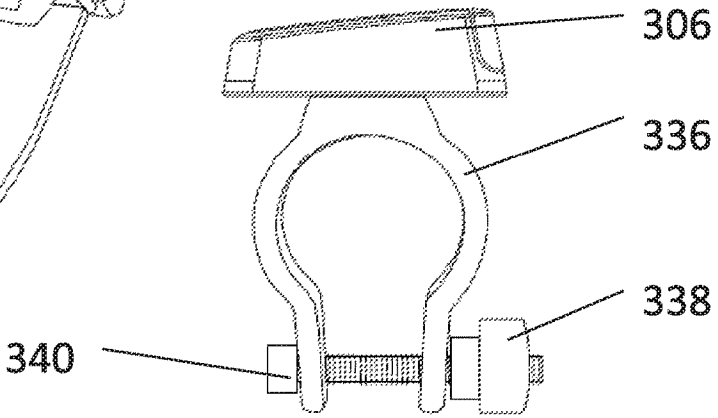
FIG. 42 shows a carrier held on a tension ring 336 according to an embodiment of the present invention.

FIG. 42 shows carrier 306 held on tension ring 336 which is closed and opened using bolt 338 and nut 340. The arrangement is particularly useful for attaching to a bicycle or motorcycle handlebar.

Figure 43:
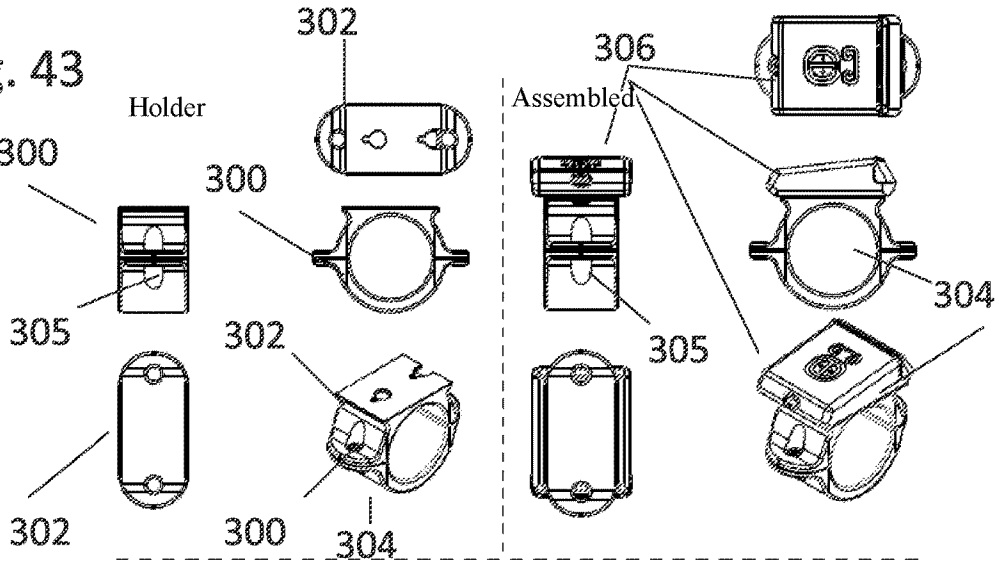
FIG. 43 shows parts of a ring-type attachment according to an embodiment of the present invention.

FIG. 43 shows parts of a ring-type attachment for attaching to a cylinder, bar or like object, such as bicycle handlebars or the mast of a windsurfer board. A ring part 300 is viewed from side on, and end on. A platform 302 is viewed from top and bottom. 304 indicates a perspective view of the platform attached to the ring part. Screws 305 allow the attachment to be tightened as necessary or taken apart.

FIG. 44 illustrates a carrier 306 attached to the assembled ring part and platform 304.

Figure 45:
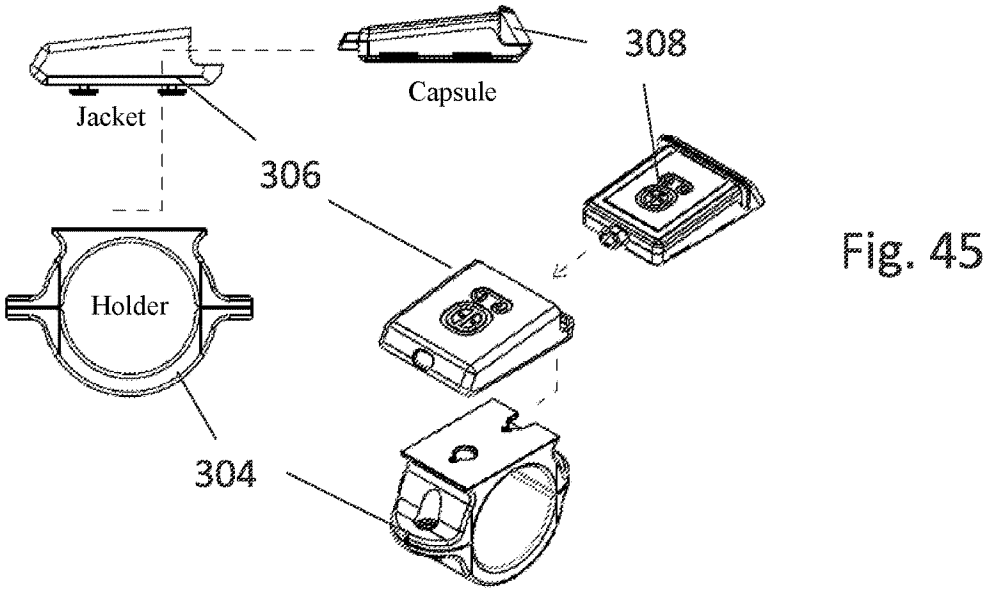
FIG. 45 illustrates the insertion of a cartridge into a carrier on the assembled ring and platform of FIG. 44.

FIG. 45 illustrates the insertion of a cartridge 308 into carrier 306 on assembled ring and platform 304.

Figure 46:
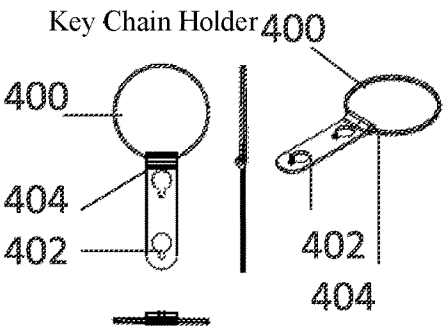
FIG. 46 shows parts of a key chain carrier according to an embodiment of the present invention.

FIG. 46 shows parts of a key chain carrier. A ring part 400 is viewed from perspective and end on. A platform 402 is viewed from the side and end-on. Link 404 attaches the platform to the ring part.

Figure 47:
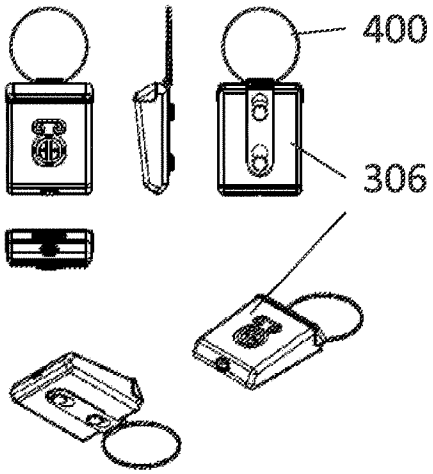
FIG. 47 illustrates a carrier attached to the assembled ring part of FIG. 46.

FIG. 47 illustrates a carrier 306 attached to the assembled ring part 400 and platform 402.

Figure 48:
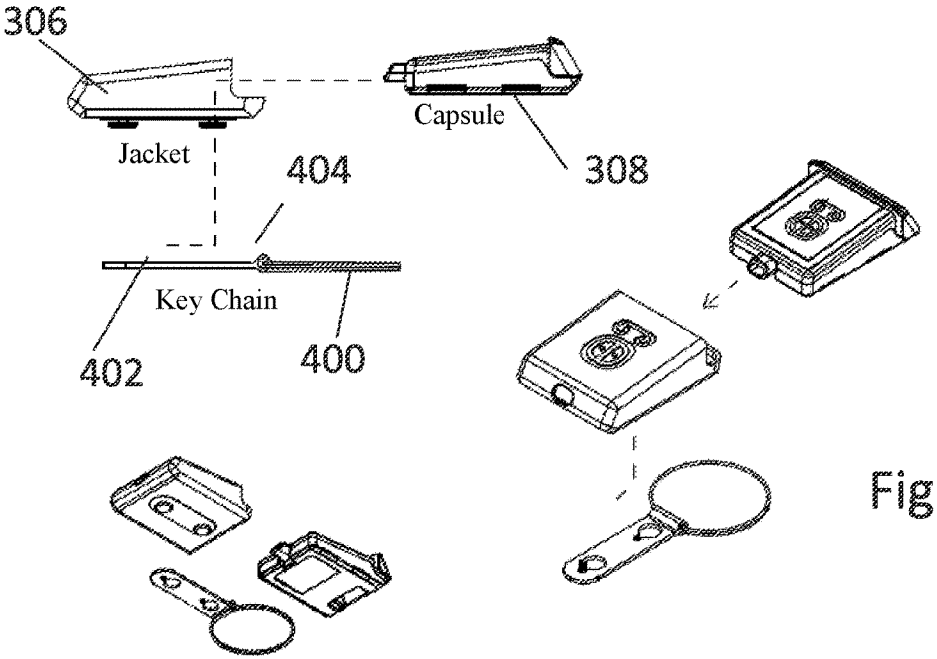
FIG. 48 illustrates the insertion of a cartridge into a carrier on the assembled ring 400 and platform of FIG. 47.

FIG. 48 illustrates the insertion of a cartridge 308 into carrier 306 on assembled ring 400 and platform 402.

Figure 49:
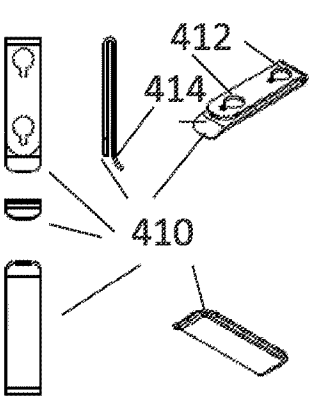
FIG. 49 shows parts of a clip-type attachment according to an embodiment of the present invention.

FIG. 49 shows parts of a clip-type attachment. A clip part 410 is viewed from side on, and end on and in perspective and has attachment holes 412 and hook end or tongue 414. The clip may fit on belts or straps and the like.

Figure 50:
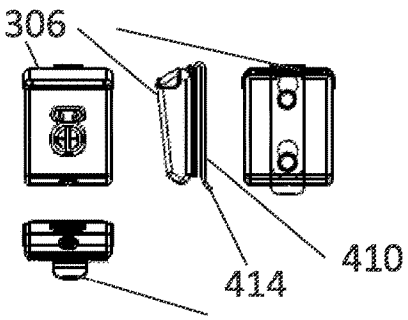
FIG. 50 illustrates a carrier attached to the clip of FIG. 49.

FIG. 50 illustrates a carrier 306 attached to the clip 410 via attachment holes 412.

Figure 51:
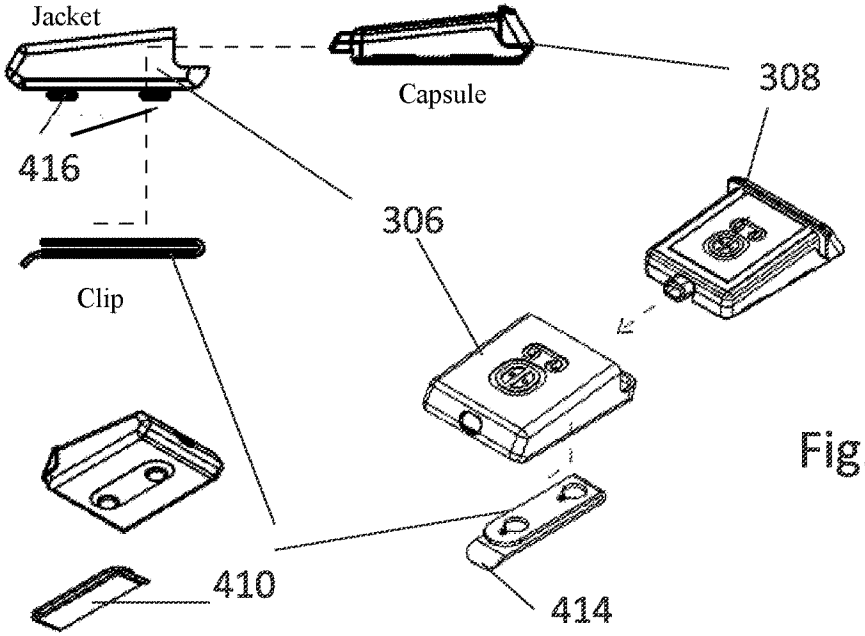
FIG. 51 illustrates the insertion of a cartridge into the carrier on the assembled clip of FIG. 50.

FIG. 51 illustrates the insertion of a cartridge 308 into carrier 306 on assembled clip 410. Lugs 416 on carrier 306 insert into the holes 412.

Figure 52:
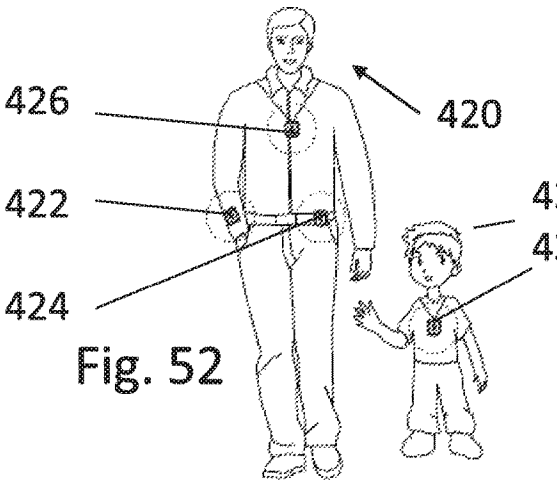
FIG. 52 is a simplified diagram illustrating an adult and child wearing cartridges according to the present embodiments.

Reference is now made to FIG. 52, which is a simplified diagram illustrating a person 420 who wears the cartridge of the present embodiments at three possible locations, on his wrist 422 with the assistance of a wrist strap as in FIG. 41, on a belt 424 with the assistance of the loops of FIG. 36 or the belt clip of FIG. 38, or the clip of FIG. 49, and around his neck 426 with the assistance of the necklace of FIG. 37. Child 430 has a device around his neck 432.

Figure 53:
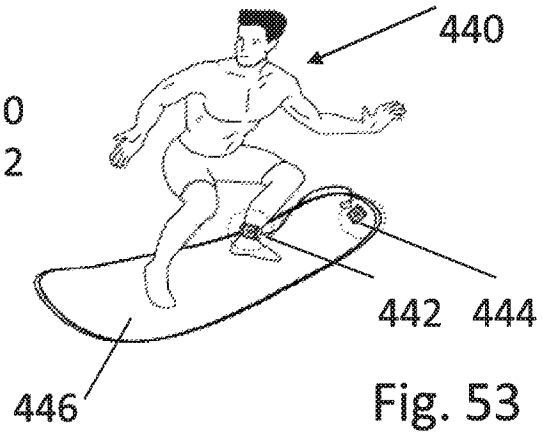
FIG. 53 illustrates a surfer 440 using a device according to the present embodiments.

Reference is now made to FIG. 53, which illustrates a surfer 440. The surfer has a device 442 attached to his ankle and connected to another point 444 attached to the surf board 446 to ensure that the device and for that matter the surfboard, are not lost during surfing.

Figure 54:
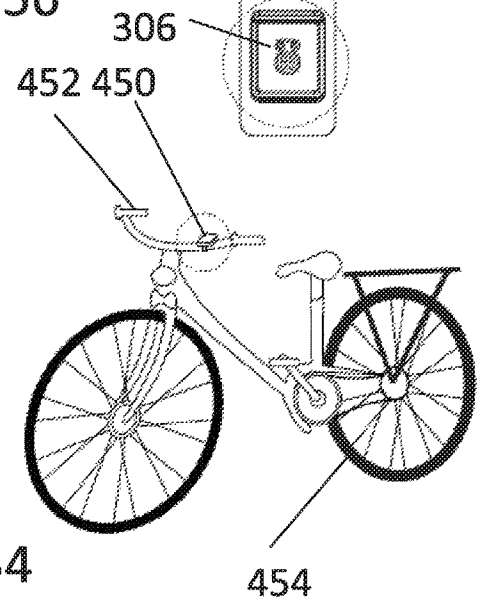
FIG. 54 illustrates a device 4 attached to handlebars of a bicycle according to an embodiment of the present invention.

In FIG. 54, a device 450 is attached to handlebars 452 of bicycle 454.

Figure 55:
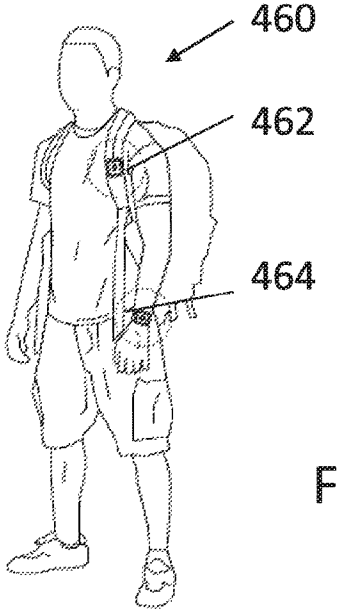
FIG. 55 illustrates a hiker with devices according to an embodiment of the present invention.

In FIG. 55, hiker 460 has one device 462 attached to the straps of his backpack, say using the loops of FIG. 36, and another 464 attached to his wrist, say using the wrist strap as in FIG. 41.

Figure 56:
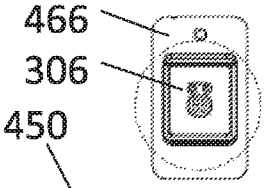
FIG. 56 illustrates a device attached to a mobile phone or a mobile phone cover, according to embodiments of the present invention.

FIG. 56 illustrates a carrier 306 attached to a mobile phone 466. The attachment may use Velcro™ and attach to a corresponding patch on a telephone cover.

Figure 57:
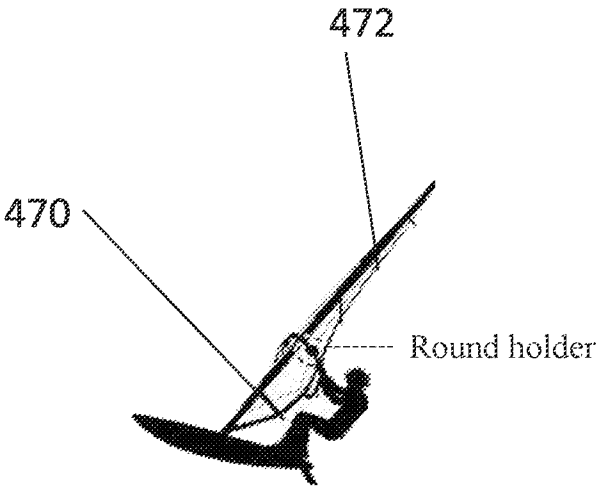
FIG. 57 illustrates a windsurfer with a device according to the present embodiments.

FIG. 57 illustrates a windsurfer with a device 470 attached to mast 472 via a ring carrier such as that of FIG. 43.

Figure 58:
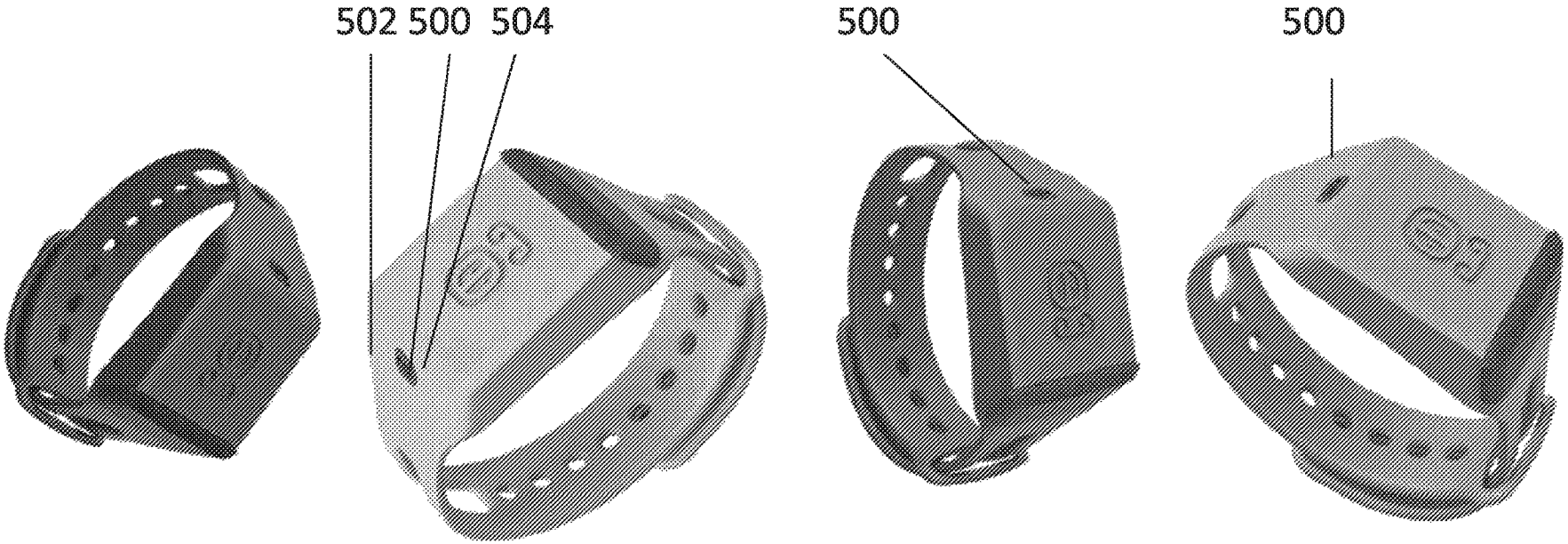
FIG. 58 illustrates several simplified views of a further embodiment of a wrist-strap type carrier.

FIG. 58 shows several views of an alternative embodiment of a wrist-strap type embodiment. Spout 500 for exuding the substance from the cartridge finishes flush with the surface 502 of the carrier and clear region 504 separates the edge of the spout from the nearest corner edge of the carrier, allowing the substance to be wiped from the carrier onto the fingers of the users.

Instead of wrist straps an attachment for attaching to a key ring or key chain or fob or the like may be used.

An attachment may be used which is designed for attaching to handlebars or handles of a two or three-wheeled vehicle such as a bicycle or motorcycle or tricycle or a ski-vehicle or a sled or a child's push chair or a pram or a wheelbarrow or similar types.

The carrier may have an attachment for attaching to a bag, such as a duffle bag, a holdall, a travel bag, a diaper bag, a rucksack, a messenger bag, a sling bag, a tote bag, a suitcase, a sportsbag or the like. Attachment may be by any many means, including sewing, gluing, Velcro™ etc and may be carried out at manufacture or later.

The carrier may be embedded in a shoulder strap of a bag as shown in FIG. 55 or of a rifle, or any other kind of shoulder strap.

Attachment to textile material may use Velcro™ or like materials or using gluing or sewing as discussed above in respect of FIG. 35.

The carrier may comprise an attachment for attaching to a watch or other wearable or portable device such as a mobile telephone.

The carrier may comprise an attachment for attaching to or embedding within clothing, including by sewing, at or after manufacture. Clothing may include sports gear and may include a wetsuit, a drysuit, a lifejacket, a ski jacket, a hat or a belt.

The attachment for clothing or for portable devices may include Velcro™ or double sided sticky tape.

As discussed above with respect to FIGS. 53 and 56, the carrier may comprise an attachment for attaching to part of a watercraft, say to cylindrical members such as the mast of a windsurfing board, or to an oar.

The carrier may include an adapter for attaching to a port of a wearable or portable device or to other small or large objects, including furniture and garden furniture.

As a further variation the carrier may be built in to or attached to jewelry such as a necklace or bangle.

The liners or sachets, or spaces without liners, may contain sunscreen lotion, liquid sunscreen, broad spectrum sunscreen, sport sunscreen, kid's sunscreen, baby sunscreen, face sunscreen, body sunscreen, water resistant sunscreen, daily moisturizers with sun protection factor (SPF), lip balm with SPF, and more generally creams and gels as well as food and any other consumable substance. For example, as well as sunscreens, cosmetics may be provided, such as, but not limited to, skin care products, including anti-aging cream, anti-wrinkle cream, moisturizer, therapeutic lotion, skin-care creams, eye and facial makeup, deodorants, lotions, perfumes, hair gel, baby products, hand sanitizer, lip gloss, lip balm, rouge blusher, shaving creams, after sun creams, fragrances and tanning products.

Medical and pharmaceutical products could be provided. These may include pastes for daily consumption such as toothpastes, acne treatments, anti-itch products, eczema treatments, ointments, say for psoriasis, antibacterial gel, dermatological creams, medicinal creams or liquids, emergency sugar cream for diabetics, diaper cream, shampoo, liquid soap, and aloe era cream or gel.

Food products may be dispensed in cartridges of the present embodiments. For example, sauces and dressings such as ketchup, salad dressing, mayonnaise etc may be dispensed from the liners herein. Liquid stock, sweeteners, coffee or tea concentrate and energy gel may likewise be dispensed in this way.

Other products that could be dispensed from liners are camouflage cream and shoe polish.

A cartridge for suncream or the like may vary in size from say 1.5 ml to last children for a few hours, to a 50 ml version to last an adult for a full day. As well as changing the size of the cartridge it is also possible to vary the size of the steps to change the dosage. For different applications, other parameters may be selected.

The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment, and the above description is to be construed as if this combination were explicitly written. Conversely, various features of the invention, which are, for brevity, described in the context of a single embodiment, may also be provided separately or in any suitable subcombination or as suitable in any other described embodiment of the invention, and the above description is to be construed as if these separate embodiments were explicitly written. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A dispensing cartridge for providing doses of a substance, the dispensing cartridge comprising:

a base;

a leverable surface;

a stepper mechanism;

a space for an application substance, the space being defined between said base part and said leverable surface, the leverable surface being retained at a first end and being downwardly pressable towards said base;

an aperture located between said leverable surface and said base for a directed exit of said application substance; and sidewalls extending upwards laterally from said base at opposite sides of said leverable surface, said sidewalls extending upwardly beyond an uppermost position of said leverable surface, thereby providing rigidity to the dispensing cartridge, wherein the stepper mechanism is located at a second end of said leverable surface to halt said leverable surface at predetermined intervals corresponding to even doses of said application substance.

2. The dispensing cartridge of claim 1, wherein the stepper mechanism includes a series of teeth extending inwardly from an outer wall of said cartridge, each tooth of the series of teeth being configured to catch said second end of said leverable surface.

3. The dispensing cartridge of claim 2, wherein the outer wall includes plastic profile configured to provide rigidity to the dispensing cartridge.

4. The dispensing cartridge of claim 1, further comprising a spout extending outwardly from said aperture.

5. The dispensing cartridge of claim 1, A dispensing cartridge for providing doses of a substance, the dispensing cartridge comprising:

a base;

a leverable surface;

a stepper mechanism;

a space for an application substance, the space being defined between said base part and said leverable surface, the leverable surface being retained at a first end and being downwardly pressable towards said base, wherein said space comprises a liner, said liner holding said application substance and includes upper and lower walls welded together along at least one weld, said weld having a weakened section located for placement opposite the aperture; and an aperture located between said leverable surface and said base for a directed exit of said application substance;

wherein the stepper mechanism is located at a second end of said leverable surface to halt said leverable surface at predetermined intervals corresponding to even doses of said application substance.

6. The dispensing cartridge of claim 5, wherein a location on a wall of said liner is weakened relative to a remainder of said liner wall, thereby ensuring that said liner bursts at said weakened location when pressed.

7. The dispensing cartridge of claim 6, further comprising:

a spout extending outwardly from said aperture;

wherein said liner being aligned such that said weakened location is opposite the spout.

8. The dispensing cartridge of claim 2, wherein the outer wall further includes an indicator showing a current level of said leverable surface.

9. The dispensing cartridge of claim 1, wherein the dispensing substance is selected from a group consisting of: a gel, a food, a cosmetic, a lotion, an ointment a sunscreen lotion, a liquid sunscreen, a broad spectrum sunscreen, a sport sunscreen, a child's sunscreen, a baby sunscreen, a face sunscreen, a body sunscreen, a water resistant sunscreen, a daily moisturizer with sun protection factor (SPF), a lip balm with SPF, a skin care product, an anti-aging cream, an anti-wrinkle cream, a moisturizer, a therapeutic lotion, a skin-care cream, eye makeup, facial makeup, a deodorant, an anti-perspirant, a perfume, hair gel, a hand sanitizer, lip gloss, lip balm, rouge blusher, a shaving cream, an after sun cream, a fragrance and a tanning product, a toothpaste, an acne treatment, an anti-itch product, an eczema treatment, a psoriasis treatment, antibacterial gel, a dermatological cream, an emergency sugar cream for diabetics, a diaper cream, a shampoo, a liquid soap, an aloe vera cream, an aloe vera gel, a sauce, a food dressing, a liquid stock, a sweetener, coffee concentrate, tea concentrate, an energy gel, and a camouflage cream and shoe polish.

10. The dispensing cartridge of claim 5, wherein the weakened section is formed by heating to soft weld the weakened section, and two weld areas at either side of the weakened section; and thereafter heating the two weld areas excluding the weakened section, thereby sealing the two weld area and leaving a weakened area between said two weld areas.

11. A carrier for the dispensing cartridge of claim 1, said carrier comprising:

a housing for containing the dispensing cartridge, said housing being pressable to allow the dispensing cartridge to be squeezed to dispense the substance;

an insertion opening at a first end of said housing through which said dispensing cartridge is removably insertable; and a dispensing opening at a second end of said housing configured to line up with a spout on said dispensing cartridge and through which said substance is dispensable.

12. The carrier of claim 11, containing the dispensing cartridge.

13. The carrier of claim 11, further comprising any one of: a strap for attachment to an arm, an attachment for attaching to a key ring, comprising an attachment for attaching to handlebars or to a cylindrical object, an attachment for attaching to a bag, an attachment for attachment to a watch or a wearable device or a mobile telephone or portable device or a bracelet, an attachment for attaching to clothing, an attachment comprising double sided sticky tape, an attachment for attaching to part of a watercraft, an adapter for attaching to a port of a wearable or portable device, an attachment for a necklace or bangle, and loops for attachment to a wrist strap.

14. A method of dispensing measured doses of a substance for application, the method comprising:

providing the dispensing cartridge of claim 1;

placing the substance in the space; and pressing the leverable surface between a first click point and a second click point to squeeze said substance for application from the space, the distance between the two click points defining a measured dose.

* * * * *